US012298043B1

(12) United States Patent
Livescu et al.

(10) Patent No.: US 12,298,043 B1
(45) Date of Patent: May 13, 2025

(54) ULTRA-COMPACT COILED TUBING (UCCT) OPERATIONS FOR GEOTHERMAL FIELD CONSTRUCTION

(71) Applicant: BEDROCK ENERGY, INC., Los Angeles, CA (US)

(72) Inventors: Silviu Livescu, Austin, TX (US); Kyle Clark, Georgetown, TX (US); Rio Whyte, Austin, TX (US); Javad Gatabi, San Marcos, TX (US)

(73) Assignee: Bedrock Energy, Inc., Los Angeles, CA (US)

( * ) Notice: Subject to any disclaimer, the term of this patent is extended or adjusted under 35 U.S.C. 154(b) by 0 days.

(21) Appl. No.: 18/629,546

(22) Filed: Apr. 8, 2024

Related U.S. Application Data

(60) Provisional application No. 63/562,947, filed on Mar. 8, 2024.

(51) Int. Cl.

| | |
|---|---|
| ***F24T 50/00*** | (2018.01) |
| ***E21B 17/20*** | (2006.01) |
| ***E21B 33/13*** | (2006.01) |
| ***E21B 33/14*** | (2006.01) |

(52) U.S. Cl.
CPC ..... *F24T 50/00* (2018.05); *E21B 17/20* (2013.01); *E21B 33/13* (2013.01); *E21B 33/14* (2013.01); *E21B 2200/20* (2020.05)

(58) Field of Classification Search
CPC ..... E21B 17/20; E21B 33/13; F24T 50/00
See application file for complete search history.

(56) References Cited

U.S. PATENT DOCUMENTS

| | | | | |
|---|---|---|---|---|
| 4,627,496 | A * | 12/1986 | Ashford | E21B 33/13 166/291 |
| 5,839,514 | A | 11/1998 | Gipson | |
| 6,021,377 | A | 2/2000 | Dubinsky et al. | |
| 6,454,014 | B2 * | 9/2002 | Coats | E21B 19/22 166/380 |
| 6,860,320 | B2 | 3/2005 | Johnson, Jr. et al. | |
| 9,488,388 | B1 | 11/2016 | Siegenthaler | |
| 9,631,478 | B2 | 4/2017 | Livescu et al. | |
| 10,280,729 | B2 | 5/2019 | Livescu et al. | |
| 10,472,944 | B2 | 11/2019 | Wassell | |
| 10,815,774 | B2 | 10/2020 | Livescu et al. | |

(Continued)

FOREIGN PATENT DOCUMENTS

CN 104453848 B 6/2019

OTHER PUBLICATIONS

Bedrock Energy, Inc., Extended European Search Report, EP23177816.8, Oct. 31, 2023, 8 pgs.

(Continued)

*Primary Examiner* — Catherine Loikith
(74) *Attorney, Agent, or Firm* — Morgan, Lewis & Bockius LLP

(57) ABSTRACT

The various embodiments described herein include systems and methods for constructing geothermal fields. In one aspect, a system for constructing a geothermal field comprises a coiled tubing. The coiled tubing is configured for drilling one or more boreholes of the geothermal field. The coiled tubing is configured for inserting one or more geothermal loops into the one or more boreholes. The coiled tubing is also configured for grouting the one or more geothermal loop.

20 Claims, 29 Drawing Sheets

(56) References Cited

U.S. PATENT DOCUMENTS

| | | | | |
|---|---|---|---|---|
| 10,822,942 | B2 | 11/2020 | Livescu et al. | |
| 10,844,707 | B2 | 11/2020 | Garner et al. | |
| 10,995,563 | B2 | 5/2021 | Søe et al. | |
| 11,520,313 | B1 * | 12/2022 | Livescu | E21B 19/22 |
| 2007/0187108 | A1 | 8/2007 | Zheng | |
| 2007/0246261 | A1 | 10/2007 | Lowe | |
| 2008/0077332 | A1 | 3/2008 | Newman | |
| 2008/0093125 | A1 * | 4/2008 | Potter | E21B 7/001 175/67 |
| 2012/0201604 | A1 | 8/2012 | Drieu | |
| 2013/0186640 | A1 | 7/2013 | Webre | |
| 2015/0083492 | A1 | 3/2015 | Wassel | |
| 2015/0260015 | A1 | 9/2015 | Ludvigsen et al. | |
| 2015/0315861 | A1 | 11/2015 | Zachariasen | |
| 2015/0322766 | A1 | 11/2015 | Veltman | |
| 2016/0314420 | A1 | 10/2016 | Livescu et al. | |
| 2018/0371889 | A1 | 12/2018 | Hohl et al. | |
| 2019/0137134 | A1 | 5/2019 | Koop | |
| 2019/0360284 | A1 | 11/2019 | Soe | |
| 2020/0355839 | A1 | 11/2020 | Jeong et al. | |
| 2022/0188712 | A1 | 6/2022 | Mittal et al. | |
| 2023/0110623 | A1 | 4/2023 | Ogundare | |

OTHER PUBLICATIONS

Livescu, Notice of Allowance, U.S. Appl. No. 17/835,905, Aug. 1, 2022, 10 pgs.

Pastorek et al., "Downhole Sensors in Drilling Operations," Proceedings, 44th Workshop on Geothermal Reservoir Engineering, Stanford University, Stanford, California, Feb. 11-13, 2019, 9 pgs.

Livescu, Office Action, U.S. Appl. No. 17/976,445, Feb. 25, 2025, 14 pgs.

* cited by examiner

| | Surface Data | Downhole data |
|---|---|---|
| **Mud Data** | Pit volume<br>Mud temperature<br>Mud pressure<br>Mud weight<br>Pump strokes | N/A |
| **Well Data** | Temperature<br>Pressure<br>Gas measurements | Temperature<br>Pressure |
| **Directional Data** | | Inclination<br>Azimuth |
| **Drilling Mechanics** | RPM<br>Weight on bit<br>Torque<br>Bending moment<br>Rotary torque<br>Hook load<br>Rate of penetration | RPM<br>Weight on bit<br>Torque on bit<br>Bending moment<br>Downhole vibration |
| **Geological data** | Cutting analysis | Density<br>Porosity<br>Resistivity<br>Gamma |

Figure 5E

ULTRA-COMPACT COILED TUBING (UCCT) OPERATIONS FOR GEOTHERMAL FIELD CONSTRUCTION

RELATED APPLICATIONS

This application claims priority to U.S. Provisional Patent Application No. 63/562,947, filed Mar. 8, 2024, titled "Ultra-Compact Coiled Tubing (UCCT) Operations for Geothermal Field Construction," which is incorporated by reference herein in its entirety.

This application is related to the following applications, all of which are incorporated by reference herein in their entireties:

(i) U.S. patent application Ser. No. 17/835,905, filed Jun. 8, 2022, titled "Geothermal Well Construction for Heating and Cooling Operations," now U.S. Pat. No. 11,520,313, issued on Dec. 6, 2022; and (ii) U.S. patent application Ser. No. 17/976,445, filed Oct. 28, 2022, titled "Coiled Tubing Drilling for Geothermal Heating and Cooling Applications."

TECHNICAL FIELD

The disclosed implementations relate generally to geothermal energy systems, and more specifically to systems, methods, and devices for geothermal field construction.

BACKGROUND

Geothermal energy is a renewable resource that harnesses the Earth's heat. Just a few feet below the surface, the Earth maintains a near-constant temperature, in contrast to the summer and winter extremes of the ambient air above ground.

Installing a geothermal heating and cooling system (GHCS) (also referred herein as a geothermal system) generally involves drilling one or more geothermal wells (e.g., geothermal boreholes) horizontally or vertically, depending on the characteristics of the site. A looped pipe is constructed from the geothermal wells, and heat is transferred between the building (e.g., a residential or commercial building) and the earth using fluid circulated through the looped pipes.

SUMMARY

Current GHCS installations have several drawbacks. First, these installations generally do not take into account surface or subsurface conditions of the site in which the geothermal system would be installed. Instead, standard-sized geothermal wells (e.g., geothermal boreholes) are usually constructed, with depths, lengths, and spacings that are pre-determined based on prior rule-of-thumb experience of the drillers. Second, current residential geothermal systems tend to have fairly shallow well depths (e.g., around 20 feet deep for horizontal geothermal loops) with a large amount of pipes buried horizontally. For example, a typical 2,000-square-foot home uses around 1,500 to 1,800 feet of pipes. Larger buildings, such as industrial, commercial or multi-story residential, would require impractical lengths of horizontal pipes.

Drilling geothermal wells without proper planning and engineering design can lead to non-optimal performance of the geothermal systems, both short-term and in the long run. This directly translates into higher operating costs and unreliable heating and cooling systems for the building owners. Furthermore, the current installation model for residential geothermal systems, which utilizes shallow geothermal wells and large horizontal areas, is not scalable for buildings that are bigger in size (e.g., commercial buildings), have higher energy loads, and/or are located in areas of higher density. For example, a commercial building located in a city may require multiple deep geothermal boreholes, constructed vertically, to be drilled for a geothermal system to properly work.

Current drilling technologies for geothermal and hydrocarbon well construction are divided between (Category A) small drilling rigs for shallow water or geothermal wells (e.g., 100 to 400 feet long vertical (e.g., deep) wells, and (Category B) large drilling rigs for deep oil and gas and conventional geothermal wells (e.g., 10,000 to 30,000 feet long vertical wells). No off-the-shelf drilling rig exists commercially for mid-range-length wells that are between 500 and 10,000 feet deep. Therefore, no off-the-shelf drilling rig has been developed for this range, leaving a technology gap between Categories A and B. While shallow water well drilling rigs (Category A) are small and portable enough to be transported and operated in high-density urban areas, they do not go very deep and are not very fast. The deep oil and gas rigs (Category B) are fast and powerful, but also large and heavy, and are meant to operate in remote areas far from urban/suburban development. This leaves a gap for fast and strong, yet compact and portable drilling rigs that can operate in urban/suburban/rural areas.

In addition to the technology gap for mid-range length geothermal wells, several constraints exist when it comes to constructing geothermal fields in urban (e.g., high-density), suburban, and, or commercial areas. These include space limitations, weight limitations (e.g., the drill rig needs to be transported to and from the construction site via paved concrete roads), and noise generated during well construction. There is also a need for improved systems, methods, and devices for drilling mid-range depth geothermal wells (e.g., about 500-10,000 feet deep, 500-5,000 feet deep, or 500-2,500 feet deep) in urban (e.g., high-density), suburban, and, or commercial areas.

Accordingly, there is a need for improved systems, methods, and devices for geothermal well construction, particularly for mid-range depth geothermal wells.

The present disclosure describes improved systems, devices, and methods for geothermal field construction. As disclosed, an ultra-compact coiled tubing unit (UCCTU) includes coiled tubing is used in a drilling phase, a geothermal loop insertion phase, and a grouting phase of a geothermal field construction. The UCCTU disclosed herein fills the technology void for mid-range-length wells that are between ~500 feet and ~3,000 feet deep. The UCCTU is designed and built considering inner-city weight, width, length, and height limitations, and can be deployed for geothermal drilling in dense urban areas, for decarbonizing buildings and reducing their dependance on the electrical grid.

The present disclosure advantageously improves upon current geothermal well construction processes in several ways. First, the current construction process requires geothermal loops to be manually inserted into boreholes. This is a difficult and physically demanding task that becomes even more challenging when the well depths are ~800 feet and upwards. Utilizing coiled tubing for geothermal loop insertion makes the process easier, faster, and more efficient. Coiled tubing can be driven into the ground using the injector. The driving force provided to the CT by the injector is large enough to push geothermal loops to depths unheard of by the current shallow geothermal drilling industry. Second, the industry currently uses Tremie lines for the grouting phase. Because grout is a viscous paste when pumped down, pumping grout through one-inch-diameter tremie lines at depths greater than ~500 to 600 feet is operationally impossible. The present disclosure improves the grouting practice by using washing nozzles attached to the coiled tubing to squeeze grout to fill spaces between a borehole and a geothermal loop.

The systems, methods, and devices of this disclosure each have several innovative aspects, no single one of which is solely responsible for the desirable attributes disclosed herein.

In accordance with some embodiments, a system for constructing a geothermal field comprises a coiled tubing that is configured for (i) drilling (e.g., constructing) one or more boreholes of the geothermal field; (ii) inserting one or more geothermal loops into the one or more boreholes; and (iii) grouting the one or more geothermal loops.

In accordance with some embodiments, an apparatus for facilitating insertion of a geothermal loop into a borehole includes a coiled tubing guide member having a first end, a second end, and an opening on a side wall of the first member. The coiled tubing guide member is configured for guiding a coiled tubing through the first end and the second end. The apparatus includes a geothermal loop guide member physically coupled to the coiled tubing guide member at the opening. The geothermal loop guide member is configured for guiding the geothermal loop through the opening and through the second end.

In accordance with some embodiments, a method for constructing geothermal fields includes (i) drilling, via a coiled tubing, one or more boreholes of a geothermal field; (ii) inserting, via the coiled tubing, one or more geothermal loops into the constructed boreholes; (iii) and grouting, via the coiled tubing, the one or more geothermal loops.

In accordance with some embodiments, a computing device includes one or more processors, memory, and one or more programs stored in the memory. The programs are configured for execution by the one or more processors. The one or more programs include instructions for performing any of the methods described herein.

In accordance with some embodiments, a non-transitory computer-readable storage medium stores one or more programs configured for execution by a computing device having one or more processors and memory. The one or more programs include instructions for performing any of the methods described herein.

Thus, methods, systems, and devices are disclosed that enable coiled tubing technology to be used drilling, geothermal loop insertion, and grouting phases of a geothermal field construction process.

Note that the various embodiments described above can be combined with any other embodiments described herein. The features and advantages described in the specification are not all inclusive and, in particular, many additional features and advantages will be apparent to one of ordinary skill in the art in view of the drawings, specification, and claims. Moreover, it should be noted that the language used in the specification has been principally selected for readability and instructional purposes and may not have been selected to delineate or circumscribe the inventive subject matter.

BRIEF DESCRIPTION OF THE DRAWINGS

FIGS. 5A, 5B, 5C, 5D-1, 5D-2, and 5D-3 illustrate a drill bit for generating geothermal boreholes in accordance with some embodiments.

FIG. 5E illustrates exemplary types of surface data and downhole data that are collected by sensors in accordance with some embodiments.

FIGS. 12A-1 and 12A-2 illustrate a geo-loop flange, in accordance with some embodiments.

FIGS. 15A-1, 15A-2, and 15A-3 illustrate a stripper flange, geo-lop flange, and a casing flange, in accordance with some embodiments.

Reference will now be made to implementations, examples of which are illustrated in the accompanying drawings. In the following description, numerous specific details are set forth in order to provide a thorough understanding of the present invention. However, it will be apparent to one of ordinary skill in the art that the present invention may be practiced without requiring these specific details.

DESCRIPTION OF IMPLEMENTATIONS

Some methods, devices, and systems disclosed in the present specification improve upon geothermal heating and cooling system (GHCS) operations by providing an integrated workflow that combines data modeling, hardware components, and a workflow for planning, executing, and/or optimizing a GHCS installation operation.

In accordance with some aspects of the present disclosure, the GHCS operation includes drilling one or more geothermal wells (e.g., boreholes). GHCS drilling employ various technologies and methods to drill and construct geothermal boreholes in urban, suburban, and rural areas. Methods of drilling geothermal boreholes include joint pipe drilling and CT drilling. Performing an optimal geothermal drilling operation involves modeling design before the operation, using downhole parameters such as a borehole size and length, mechanical friction forces, tensile forces, pumping rates, soil and rock properties, pressure and/or temperature. Some aspects of the present disclosure describe using surface and subsurface (e.g., underground) sensors for acquiring data such as pressure, temperature, depth correlation and azimuth, rock hardness, pumping rates, etc., for adjusting the pre-operation design in real time while drilling. Some aspects of the present disclosure describe using the same model after the GHCS drilling and construction operation is finished, to monitor the geothermal loop inlet and outlet temperature and enthalpy, the indoor temperature, and/or the coefficient of performance of the heat pump in real time, and to adjust the pump rate to maintain an optimal heating and cooling performance.

In this disclosure, a "geothermal field" is also referred to as a "geo-field." Both of these terms have the same meaning.

In this disclosure, a "geothermal loop" is also referred to as a "geo-loop." Both of these terms have the same meaning.

Figure 1:
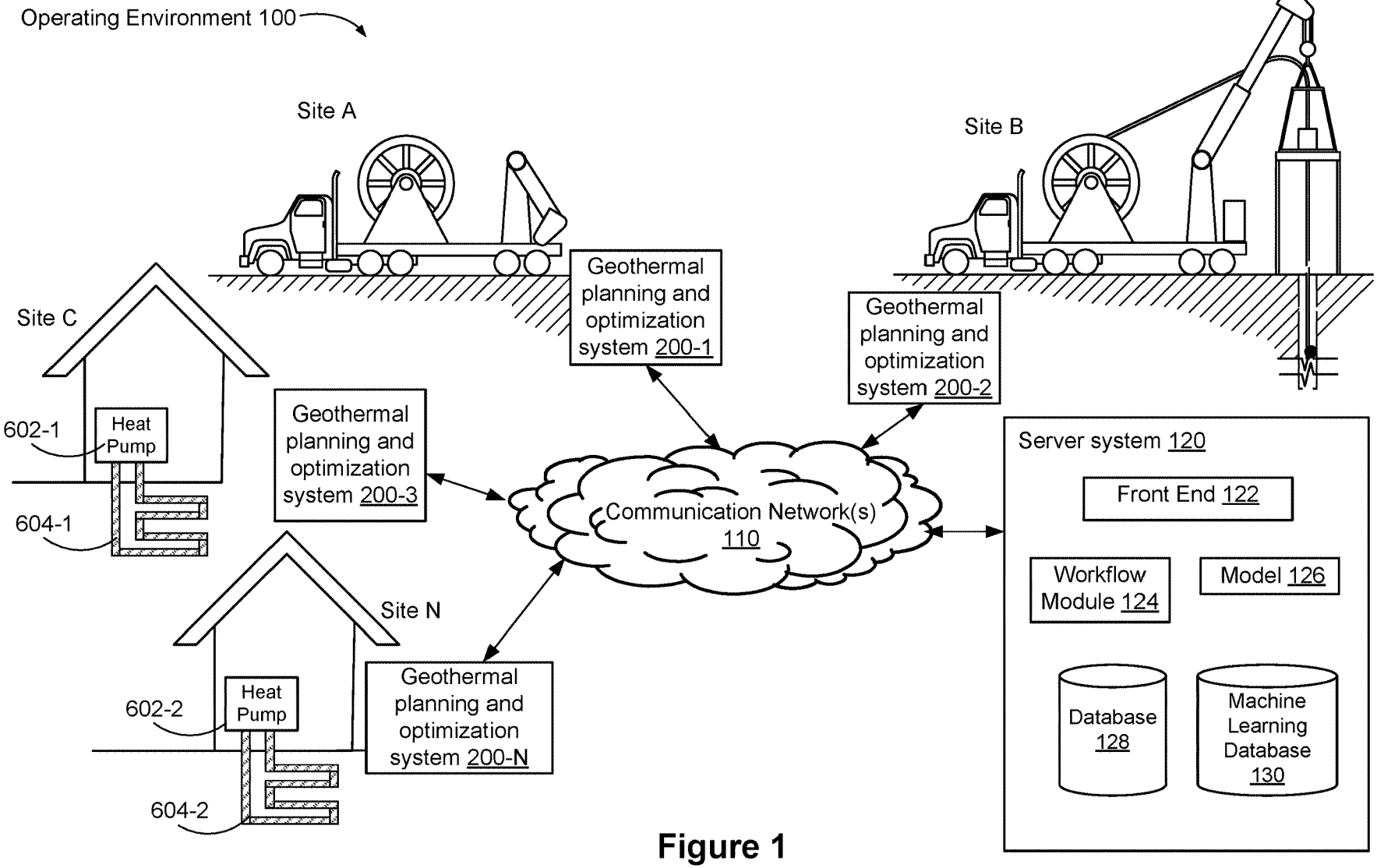
FIG. 1 illustrates an operating environment in accordance with some embodiments.

FIG. 1 illustrates an operating environment 100 in accordance with some embodiments. In some embodiments, the operating environment 100 includes one or more geothermal planning and optimization systems 200 (e.g., a computer system a computing device, or an electronic device). In the example of FIG. 1, each of the systems 200-1, 200-2, 200-3, and 200-N is located at a respective (e.g., distinct) site (e.g., Site A, Site B, Site C, Site N), corresponding to a respective (e.g., distinct) city, state, or country.

In some embodiments, each of the geothermal planning and optimization systems 200 is configured to be operable at various phases (e.g., all phases, all stages, or a subset thereof) of a GHCS operation. The phases can include a pre-construction phase, a construction phase, and a post-construction phase. For example, in FIG. 1, the geothermal planning and optimization system 200-1 located in Site A corresponds to the pre-construction phase. The system 200-2 located in Site B corresponds to the construction phase. The systems 200-3 and 200-N, in Site C and Site N respectively, correspond to the post-construction phase.

In some embodiments, the geothermal planning and optimization system 200 is communicatively coupled through communication network(s) 110 to a server system 120.

In some embodiments, the server system 120 includes a front end server 122 that facilitates communication between the server system 120 and the geothermal planning and optimization system 200. The front end server 122 is configured to receive information from the geothermal planning and optimization system 200. For example, during the planning (e.g., pre-construction) phase for a geothermal borehole construction project at Site A, the front end server 122 can receive (e.g., in real-time), from the geothermal planning and optimization system 200-1, information such as building size, site information, and/or data regarding rock type found at Site A. As another example, during the construction of a geothermal borehole at Site B, the front end server 122 can receive (e.g., in real-time) from the geothermal planning and optimization system 200-2 information such as sensor data collected by one or more sensors of a drilling rig that is performing the borehole construction at Site B. As another example, the front end server 122 can receive (e.g., in real-time) from the geothermal planning and optimization system 200-3 information such as a fluid flow rate, a heat pump coefficient of performance (COP) for heating, and/or a heat pump energy efficiency ratio (EER) for cooling, corresponding to a geothermal loop 604-1 at Site C.

In some embodiments, the front end server 122 is configured to send information to the one or more geothermal planning and optimization systems 200. For example, the front end server 122 can send operational parameters (e.g., drilling depth, diameter, and/or direction) to the geothermal planning and optimization system 200-1, to facilitate drilling of the geothermal borehole at Site A. As another example, in response to receiving the sensor data from the geothermal planning and optimization system 200-2, the front end server 122 can send updated operational parameters to the geothermal planning and optimization system 200-2, to control (e.g., optimize) the dimensions of the geothermal borehole that is being constructed art Site B. As another example, in response to receiving data associated with the geothermal loop 604-1, the front end server 122 can send to the geothermal planning and optimization system 200-3 information such as a desired flow rate for the working fluid, so as to optimize the operation of the geothermal loop 604-1.

In some embodiments, the server system 120 includes a workflow module 124 for providing an integrated workflow 628 corresponding a geothermal heating and cooling system operation. Details of the workflow module 124 are described in FIGS. 2 and 3, and 6A to 6C, as well as U.S. patent application Ser. No. 17/835,905 and U.S. patent application Ser. No. 17/976,445, both of which are incorporated by reference herein in their entireties.

In some embodiments, the server system 120 includes a model 126 (e.g., a physics-based model, a mathematical-based model, a data-driven model, a machine learning algorithm) for modeling the heating and cooling loads of the building, the heat pump, and the GHCS well (e.g., geothermal borehole(s)) sizes and lengths. Details of the model 126 are discussed in FIGS. 2 and 3.

Figure 3:
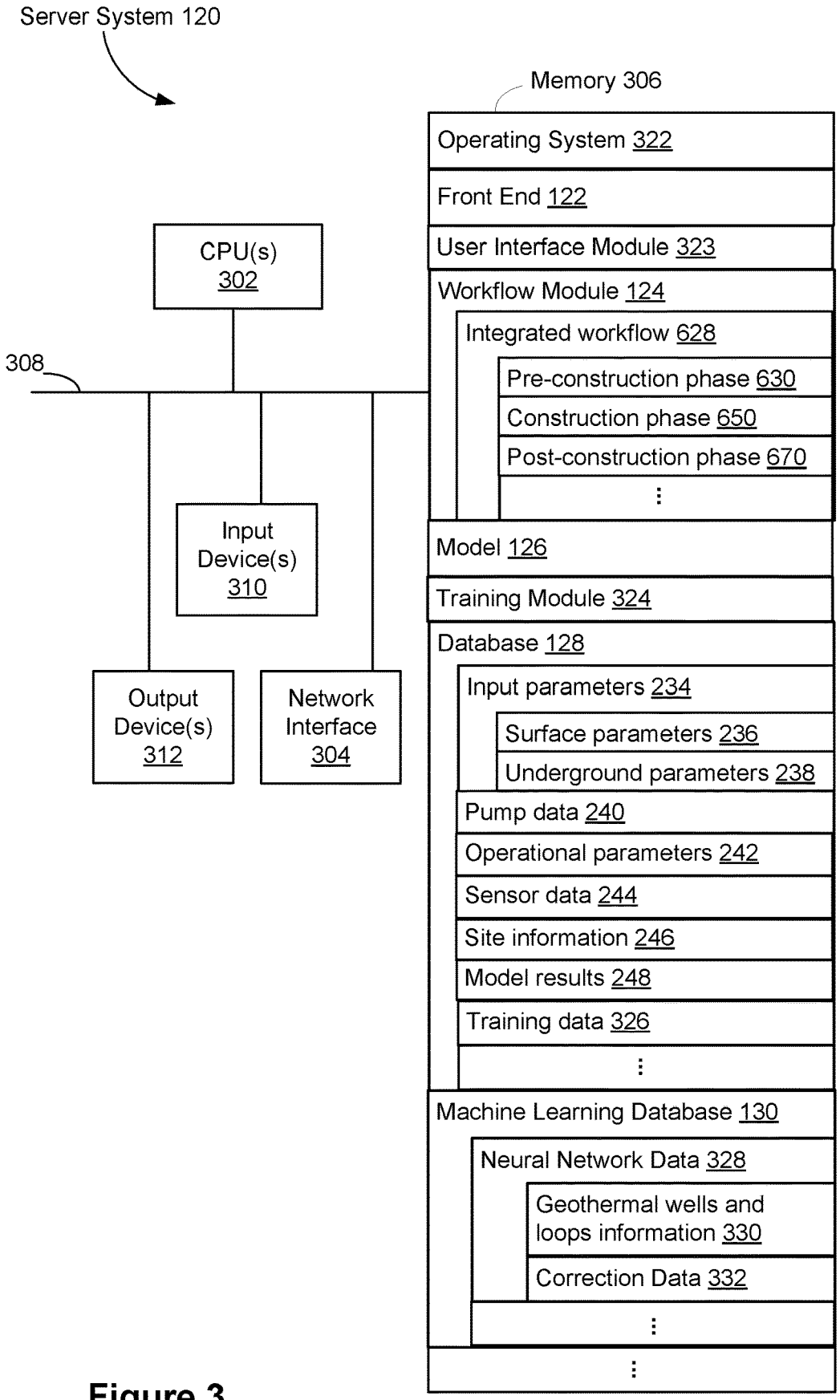
FIG. 3 is a block diagram illustrating a server system, in accordance with some embodiments.

In some embodiments, the server system 120 includes a database 128, which is described with respect to FIG. 3.

In some embodiments, the server system 120 includes a machine learning database 130 that stores machine learning information. In some embodiments, the machine learning database 130 is a distributed database. In some embodiments, the machine learning database 130 includes a deep neural network database. In some embodiments, the machine learning database 130 includes supervised training and/or reinforcement training databases.

Figure 2:
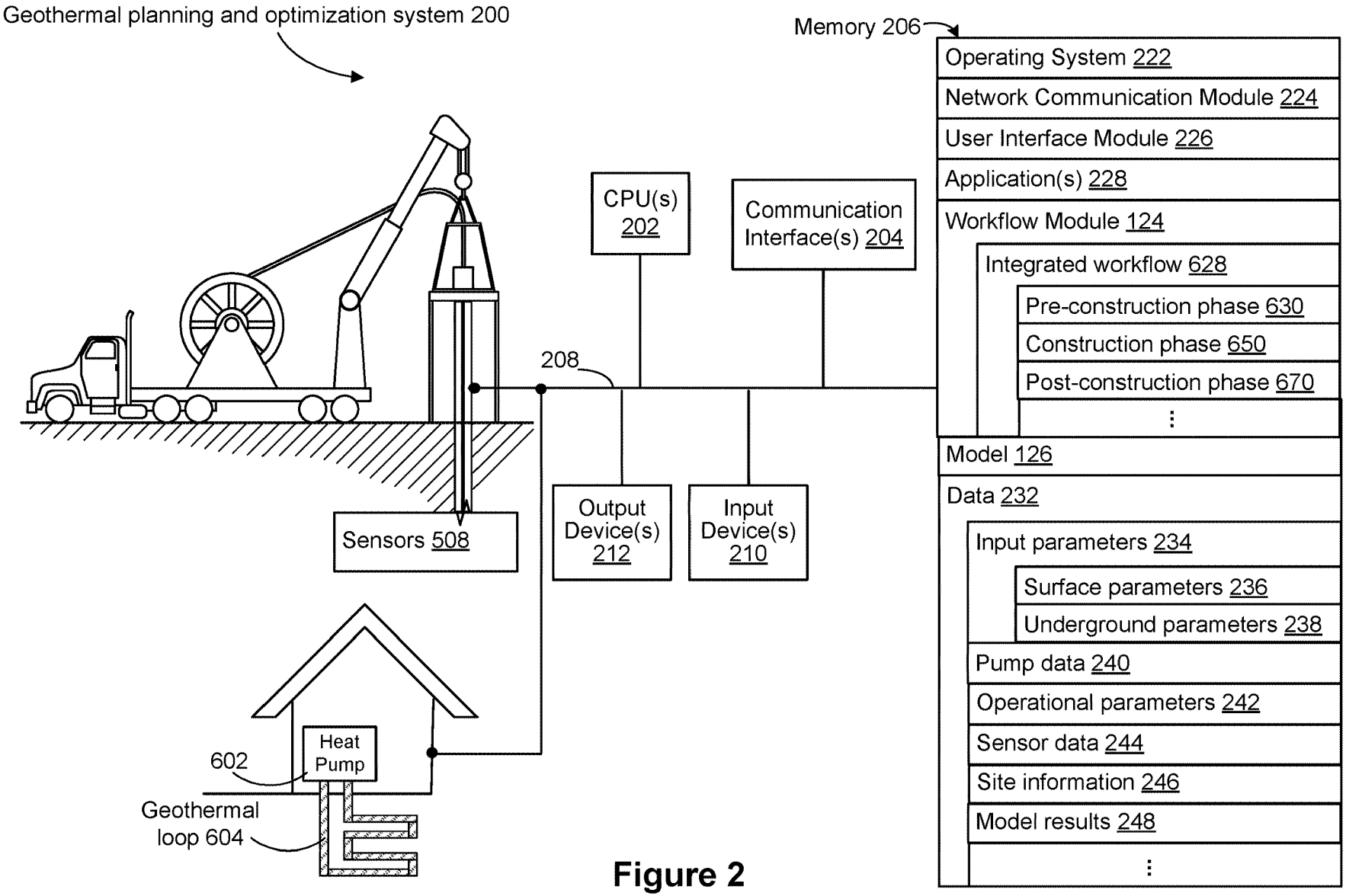
FIG. 2 illustrates a block diagram of a geothermal planning and optimization system according to some embodiments.

FIG. 2 illustrates a block diagram of a geothermal planning and optimization system 200 according to some embodiments.

The system 200 typically includes one or more processors (e.g., processing units, or CPUs) 202, one or more network or other communication interfaces 204, memory 206, and one or more communication buses 208 for interconnecting these components. In some embodiments, the communication buses 208 include circuitry (sometimes called a chipset) that interconnects and controls communications between system components.

In some embodiments, the system 200 is communicatively connected to one or more sensors 508 that are positioned on a drill bit 502 of a CT 408 and/or a joint pipe 422, the details of which are described in FIGS. 4, 5, and 6.

In some embodiments, the system 200 is communicatively connected to one or more heat pumps 602 that are operably coupled to one or more respective geothermal loops 604. Details of the heat pump 602 and the geothermal loop are described in FIG. 7.

The system 200 includes one or more input devices 210 that facilitate user input, such as a keyboard, a mouse, a voice-command input unit or microphone, a touch screen display, a touch-sensitive input pad, a gesture capturing camera, or other input buttons or controls. In some embodiments, the system 200 includes one or more cameras or scanners for capturing data. The system 200 also includes one or more output devices 212 that enable presentation of user interfaces and display content, including one or more speakers and/or one or more visual displays.

In some embodiments, the memory 206 includes high-speed random access memory, such as DRAM, SRAM, DDR RAM, or other random access solid state memory devices; and, optionally, includes non-volatile memory, such as one or more magnetic disk storage devices, one or more optical disk storage devices, one or more flash memory devices, or one or more other non-volatile solid state storage devices. In some embodiments, the memory 206 includes one or more storage devices remotely located from one or more processing units 202. The memory 206, or alternatively the non-volatile memory device(s) within the memory 206, includes a non-transitory computer-readable storage medium. In some embodiments, the memory 206 or the computer-readable storage medium of the memory 206 stores the following programs, modules, and data structures, or a subset or superset thereof:

- an operating system 222, including procedures for handling various basic system services and for performing hardware dependent tasks;
- a communications module 224, which is used for connecting the system 200 to other systems, computers and devices via the one or more communication interfaces 204 (wired or wireless), such as the communication network(s) 110, Internet, other wide area networks, local area networks, metropolitan area networks, and so on;
- a user interface module 226, which enables presentation of information (e.g., a graphical user interface for application(s) 228, widgets, websites and web pages thereof, and/or audio and/or video content, text, etc.) at the system 200 via one or more output devices 212 (e.g., displays, speakers, etc.);
- one or more user applications 228, which are executed by the system 200 (e.g., web or non-web based applications for controlling another system, electronic device, or sensors, or for reviewing data captured by such devices);
- a workflow module 124, which provides an integrated workflow 628 corresponding a GHCS operation;
- a model 126, which models the heating and cooling loads of the building, the heat pump, and the GHCS well (e.g., geothermal borehole(s)) sizes and lengths); and
- data 232, including:
  - input parameters 234. In some embodiments, the input parameters 234 include surface parameters 236. The surface parameters 236 include: building size, building type (e.g., wall material and insulation; roof type; number, size, and orientation of windows; ventilation system; etc.), location, outdoor temperature, heat pump size, heat pump type, and/or inlet/outlet temperatures of the geothermal loop. In some embodiments, the input parameters 234 include underground parameters 238. The underground parameters 238 include: fluid type (e.g., density and/or viscosity, and thermal conductivity), geothermal loop roughness, inlet temperatures of the geothermal loop(s), geothermal loop length and/or depth, size (e.g., diameter), and trajectory (e.g., vertical, horizontal, inclined, and/or deviated), geothermal loop material/heat transfer coefficient, soil and/or rock type and properties, aquifer depth and height, grout/cement/casing heat transfer coefficients, and geothermal working fluid flow rate;
  - pump data 240, including manufacturer heat pump COP (for heating) and/or EER (for cooling) and/or calculated heat pump COP and/or EER (e.g., during borehole construction or during operation of a geothermal loop);
  - operational parameters 242, including drilling depth(s), drilling diameter(s), and/or drilling direction(s);
  - sensor data 244. In some embodiments, the sensor data 244 is collected automatically and/or in real time. In some embodiments, the sensor data 244 is collected directly (e.g., by sensors 508 or sensors 510) or by indirect measurements. In some embodiments, the sensor data 244 includes surface data and/or downhole data, as illustrated in FIG. 5E;
  - site information 246, including geographical location(s) of geothermal borehole(s), rock conditions, heat pump(s), geothermal loop(s) and their inlet and outlet temperatures, working fluid type(s), and/or working fluid flow rates; and
  - model results 248 generated by the model 126.

In some embodiments, the integrated workflow 628 includes a combination of one or more workflows, each corresponding to a respective phase of a geothermal heating and cooling operation (e.g., a geothermal project). The integrated workflow 628 can include a combination of: a pre-construction phase workflow 630, a construction phase workflow 650, and a post-construction phase workflow 670. In some embodiments, each of the workflows 630, 650, and 670 can be executed as a standalone workflow. Further details of the workflows 630, 650, and 670 are discussed in FIGS. 6A to 6C, as well as in U.S. patent application Ser. No. 17/835,905 and U.S. patent application Ser. No. 17/976,445, both of which are incorporated by reference in their entireties.

In some embodiments, the model 126 comprises a physics-based model, a mathematical-based model, a data-driven model, and/or a machine learning algorithm. In some embodiments during a pre-construction phase, the model 126 uses data 232, such as input parameter(s) 234, a heat pump COP for heating, and/or a heat pump EER for cooling, to predict (e.g., estimate) the length and/or depth of the borehole(s) to be drilled and/or estimate one or more locations for the boreholes. The model 126 generates operational parameters 242 for constructing a geothermal borehole. In some embodiments, during a construction phase, the model 126 uses sensor data 244 (e.g., collected in real time using sensors 508 and/or sensors 510) to further refine and/or optimize the operational parameters 242. In some embodiments, during a post-construction phase, the model 126 uses inputs such as a surface air temperature, a building size, a heat pump COP for heating, and/or a heat pump EER for cooling, for determining heat exchange parameters at a geothermal loop and determining an optimized flow rate of the fluid in the geothermal loop.

In some embodiments, the model 126 comprises a subsurface fluid transport and heat transfer model. The model 126 allows a user to automatedly engineer an entire subsurface system (e.g., engineer the number, size(s), length(s) of geothermal wells (e.g., boreholes), and the distance between wells) specifically designed for each building.

In some embodiments, the model 126 includes a surface sub-model and an underground sub-model. The surface sub-model solves energy balance equations for the building and heat pump(s). For example, the surface sub-model uses a subset of the surface parameters 236 and generates, as outputs, the heat pump efficiency and the geothermal working fluid flow rate. The underground sub-model solves mass, momentum, and energy conservation equations in the geothermal loop(s) and radial diffusivity equation(s) in the underground rocks around the geothermal borehole(s). The underground sub-model uses a subset of the underground parameters 238 and generates (e.g., outputs) an outlet temperature of the geothermal loop. In some embodiments, the model 126 couples the surface sub-model and the underground sub-model and solves them together. In this instance, the model 126 uses a subset of the surface parameters 236 and the underground parameters 238 as inputs, and calculates an optimum heat pump efficiency by adjusting the geothermal working fluid flow rate. The unknowns in the model 126 include: underground heat transfer coefficients in the rocks, aquifer, and grout/cement (e.g., the grout/cement thickness may vary along the borehole length). Thus, inlet/outlet temperatures of the geothermal loops and geothermal working fluid flow rates (e.g., site information 246) are measured over time and data sets (e.g., training data training data 326) are built to predict the underground heat transfer coefficients using non-linear least square solvers such as the gradient-based Levenberg-Marquardt algorithm. This, in turn, allows for adjusting the geothermal working fluid flow rates for continuously optimal heat pump efficiencies (e.g., during the day, at night or every day of the year).

Although FIG. 2 shows a system 200, FIG. 2 is intended more as a functional description of the various features that may be present rather than as a structural schematic of the implementations described herein. In practice, and as recognized by those of ordinary skill in the art, items shown separately could be combined and some items could be separated.

Each of the above identified executable modules, applications, or sets of procedures may be stored in one or more of the memory devices, and corresponds to a set of instructions for performing a function described above. The above identified modules or programs (i.e., sets of instructions) need not be implemented as separate software programs, procedures, or modules, and thus various subsets of these modules may be combined or otherwise re-arranged in various implementations. In some embodiments, the memory 206 stores a subset of the modules and data structures identified above. Furthermore, the memory 206 may store additional modules or data structures not described above (e.g., module(s) for machine learning and/or training models). In some embodiments, a subset of the programs, modules, and/or data stored in the memory 206 can be stored on and executed by server system 120 or by system 1000.

FIG. 3 is a block diagram illustrating a server system 120, in accordance with some embodiments.

The server system 120 includes one or more processors 302 (e.g., processing units of CPU(s)), one or more network interfaces 304, memory 306, and one or more communication buses 308 for interconnecting these components (sometimes called a chipset), in accordance with some embodiments.

In some embodiments, the server system 120 includes one or more input devices 310 that facilitate user input, such as a keyboard, a mouse, a voice-command input unit or microphone, a touch screen display, a touch-sensitive input pad, a gesture capturing camera, or other input buttons or controls. In some embodiments, the server system 120 uses a microphone and voice recognition or a camera and gesture recognition to supplement or replace the keyboard. In some embodiments, the server system 120 includes one or more output devices 312 that enable presentation of user interfaces and display content, such as one or more speakers and/or one or more visual displays.

The memory 306 includes high-speed random access memory, such as DRAM, SRAM, DDR RAM, or other random access solid state memory devices; and, in some embodiments, includes non-volatile memory, such as one or more magnetic disk storage devices, one or more optical disk storage devices, one or more flash memory devices, or one or more other non-volatile solid state storage devices. In some embodiments, the memory 306 includes one or more storage devices remotely located from the one or more processors 302. The memory 306, or alternatively the non-volatile memory within the memory 306, includes a non-transitory computer-readable storage medium. In some embodiments, the memory 306, or the non-transitory computer-readable storage medium of the memory 306, stores the following programs, modules, and data structures, or a subset or superset thereof:

- an operating system 322, including procedures for handling various basic system services and for performing hardware dependent tasks;
- a front end 122, which communicatively couples the server system 120 to other devices and/or systems (e.g., the geothermal planning and optimization systems 200-1, 200-2, 200-3, . . . , 200-N) via the network interface(s) 304 (wired or wireless) and one or more networks, such as communication network(s) 110, the Internet, other wide area networks, local area networks, metropolitan area networks, and so on;
- a user interface module 323, which enables presentation of information (e.g., a graphical user interface for presenting application(s), widgets, websites and web pages thereof, games, audio and/or video content, text, etc.) either at the server system or at a geothermal planning and optimization system 200 (e.g., a computing device);
- a workflow module 124, which provides an integrated workflow 628 corresponding a GHCS operation. In some embodiments, the integrated workflow 628 includes one or more of: a pre-construction phase workflow 630, a construction phase workflow 650, and a post-construction phase workflow 670;
- a model 126;
- a training module 324, which generates and/or trains geothermal planning and optimization models (e.g., model 126) for predicting underground heat transfer coefficient(s). In some embodiments, the training module 324 uses training data 326 to generate and/or train the models. In some embodiments, the training data 326 (e.g., training data sets) is generated from geothermal loop inlet/outlet temperature measurements over time (e.g., one month, six months, one year, five years) and/or geothermal working fluid flow rate measurements over time. In some embodiments, the training data 326 is generated from nearby buildings or from buildings with similar thermal energy loads. In some embodiments, the training module 324 uses non-linear least square solvers such as the gradient-based Levenberg-Marquardt algorithm, for predicting underground heat transfer coefficient(s) for a GHCS site location. This, in turn, allows for adjusting the geothermal working fluid flow rates for continuously optimal heat pump efficiencies (i.e., during the day or at night, every day of the year);

a database 128, which stores data used, collected, and/or created by the workflow module 124, the model 126, and/or the training module 324. The database 128 may store input parameters 234, including surface parameters 236 and/or underground parameters 238, which provide the data used in the model 126, the integrated workflow 628, and/or the workflows 630, 650, and 670. In some embodiments, the database 128 stores pump data 240 of heat pumps that are installed at sites utilizing the system 200. In some embodiments, the database 128 stores operational parameters 242 for constructing geothermal borehole(s), including drilling depth(s), drilling diameter(s), and/or drilling direction(s). In some embodiments, the database 128 stores sensor data 244 that are collected by surface and/or subsurface sensors (e.g., sensors 508 and/or sensors 510) located at various geothermal sites. In some embodiments, the database 128 stores site information 246 of sites equipped with the system 200, including geographical location(s) of geothermal borehole(s), rock conditions, heat pump(s), geothermal loop(s) and their inlet and outlet temperatures, working fluid type(s), and/or working fluid flow rates. In some embodiments, the database 128 stores model results 248 generated by the model 126. In some embodiments, the database 128 stores training data 326. In some embodiments, the database 128 stores the data by site locations. In some embodiments, the database 128 stores the data by a respective identifier of the system(s) 200;

In some embodiments, the memory 306 includes a machine learning database 130 for storing machine learning information. In some embodiments, the machine learning database 130 includes the following datasets or a subset or superset thereof:

neural network data 328, including information corresponding to the operation of one or more neural network(s), including, and not limited to:

geothermal wells and loops information 330, including information (e.g., feature vectors) corresponding to different locations and/or configurations of geothermal wells (e.g., geothermal boreholes) and geothermal loops; and correction data 332 corresponding to the geothermal wells and loops information 330.

In some embodiments, the server system 120 includes a device registration module for registering devices (e.g., the computer device and system) for use with the server system 120.

In some embodiments, the server system 120 includes a notification module (not shown) for generating alerts and/or notifications for users of the geothermal planning and optimization system(s) 200. For example, in some embodiments the model 126 (or the workflow module 124) is stored locally on the system 200 of the user, the server system 120 may generate notifications to alert the user to download the latest version(s) or update(s) to the model.

Each of the above identified elements may be stored in one or more of the memory devices described herein, and corresponds to a set of instructions for performing the functions described above. The above identified modules or programs need not be implemented as separate software programs, procedures, modules or data structures, and thus various subsets of these modules may be combined or otherwise re-arranged in various implementations. In some embodiments, the memory 306 stores a subset of the modules and data structures identified above. In some embodiments, the memory 306 stores additional modules and data structures not described above. In some embodiments, a subset of the programs, modules, and/or data stored in the memory 306 can be stored on and/or executed by the geothermal planning and optimization system 200. In some embodiments, a subset of the programs, modules, and/or data stored in the memory 306 can be stored on and/or executed by system 1000.

Figure 4A:
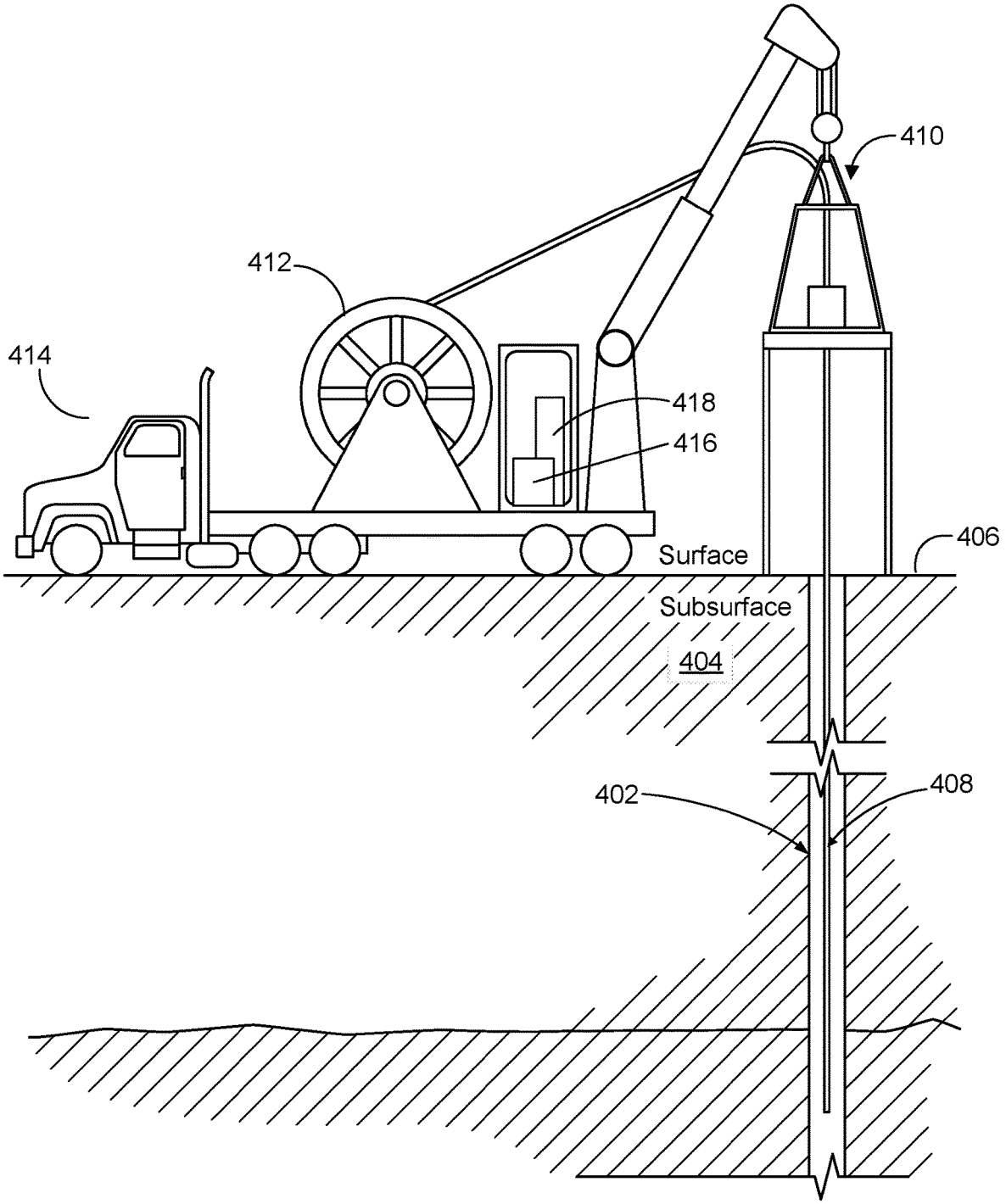
FIGS. 4A and 4B illustrate drilling of a geothermal borehole in accordance with some embodiments.
Figure 4B:
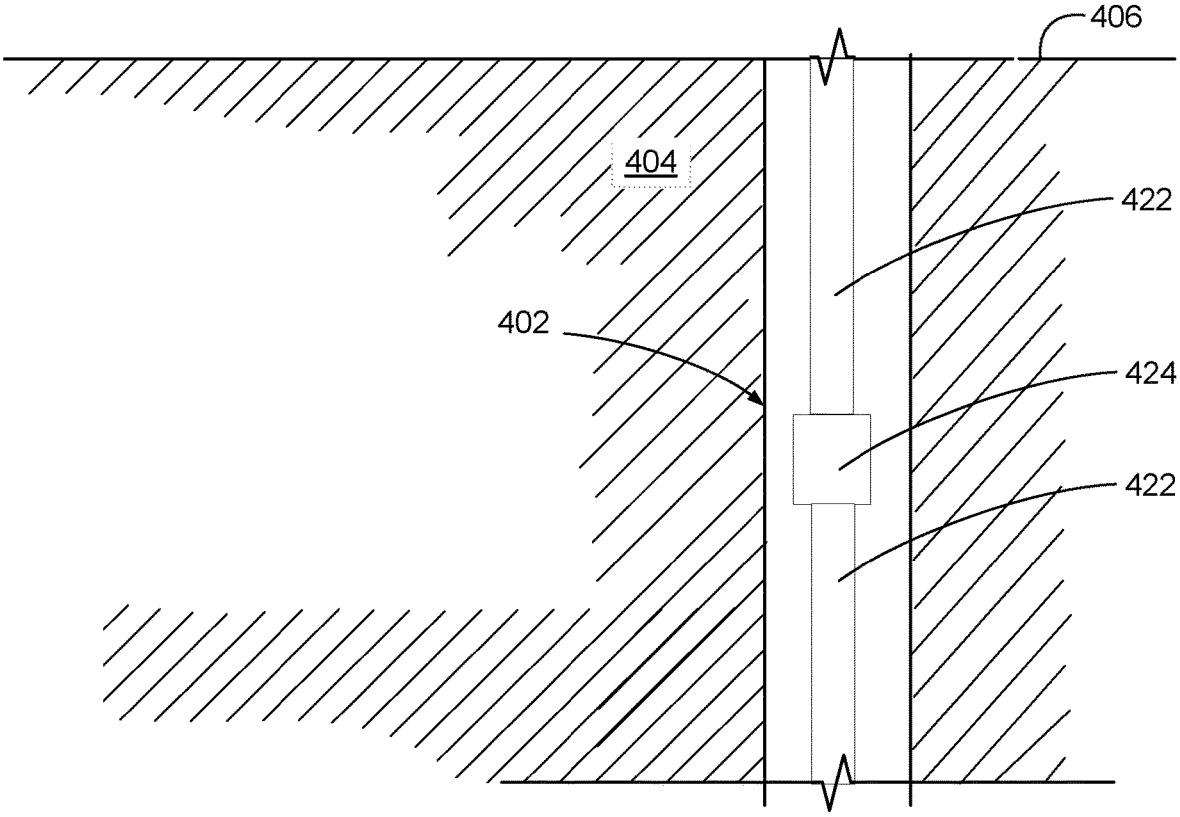

FIGS. 4A and 4B illustrate drilling of a geothermal borehole (e.g., a geothermal well) in accordance with some embodiments. In FIG. 4A, an exemplary geothermal borehole 402 has been (e.g., is being) drilled through the earth 404 from the surface 406. While the geothermal borehole 402 in FIG. 4A is illustrated as a substantially vertical borehole, it might, in practice, have portions that are inclined or horizontally-oriented.

In some embodiments, as illustrated in FIG. 4A, a drill rig comprising CT 408 is used for constructing the geothermal borehole 402. The CT 408 is tubing that is sufficiently flexible that long lengths can be coiled onto a spool and stored on a CT reel 412 that is mounted on a truck 414, so that it can be injected into a geothermal borehole 402 using a CT injector 410. In some embodiments, the truck 414 is provided with a radio frequency (RF) power source or generator 416 and motorized equipment 418 of a type known in the art to rotate the reel 412.

In accordance with some embodiments of the present disclosure, the CT reel 412 and/or the CT injector 410 are purposefully re-designed and re-sized for drilling geothermal boreholes with depths of about 1,000 to 2,000 feet. Current drilling technologies for geothermal and hydrocarbon well construction are divided between two categories: (A) small drilling rigs for shallow water or geothermal wells, usually drilling 100- to 400-feet long vertical wells, and (B) large drilling rigs for deep oil & gas and conventional geothermal wells, usually for 10,000 to 30,000 feet long wells. In oil and gas drilling and conventional geothermal drilling, no significant demand has historically existed for mid-range lengths, e.g., between 500 and 10,000 feet. Therefore, no off-the-shelf drilling rig has been developed for this range, leaving a technology gap between (A) and (B). While shallow water well drilling rigs (Category A) are small and portable enough to be transported and operated in high-density urban areas, they do not go very deep and are not very fast. The deep oil and gas rigs (Category B) are fast and powerful, but also large and heavy, and are meant to operate in remote areas far from urban/suburban development. This leaves a gap for fast and strong, yet compact and portable drilling rigs that can operate in urban/suburban/rural areas.

In some embodiments, as illustrated in FIG. 4B, a drill rig comprising one or more joint pipes 422 (e.g., joint drill pipes) are used for constructing the geothermal borehole 402. The joint pipes 422 are straight pipes having a fixed length (e.g., 10 feet long) and that are connected together via one or more tool joints 424 while drilling. For example, rigs for drilling geothermal wells for single-family residential applications (Category A) have joint pipes between 10 and 20 feet long.

Current drilling rigs (Categories A and B) use joint pipes. Drilling down, and then exiting the borehole on the way back up, must slow to a standstill when two joint pipes must be connected together. This repetitive process limits the average drilling speed to about 10-100 feet/hour for the entire well drilling operation. In contrast, with continuous CT drilling, the average drilling speeds can reach 150-200 feet/hour. These faster drilling speeds allow a significant reduction in time and operational costs: for instance, a 400-feet long geothermal well can be drilled in only 2 hours, instead of 20+ hours required by the shallow water well drilling rigs (Category A).

FIGS. 5A, 5B, 5C, 5D-1, 5D-2, and 5D-3 illustrate a drill bit 502 for generating geothermal boreholes according to some embodiments.

Figure 5A:
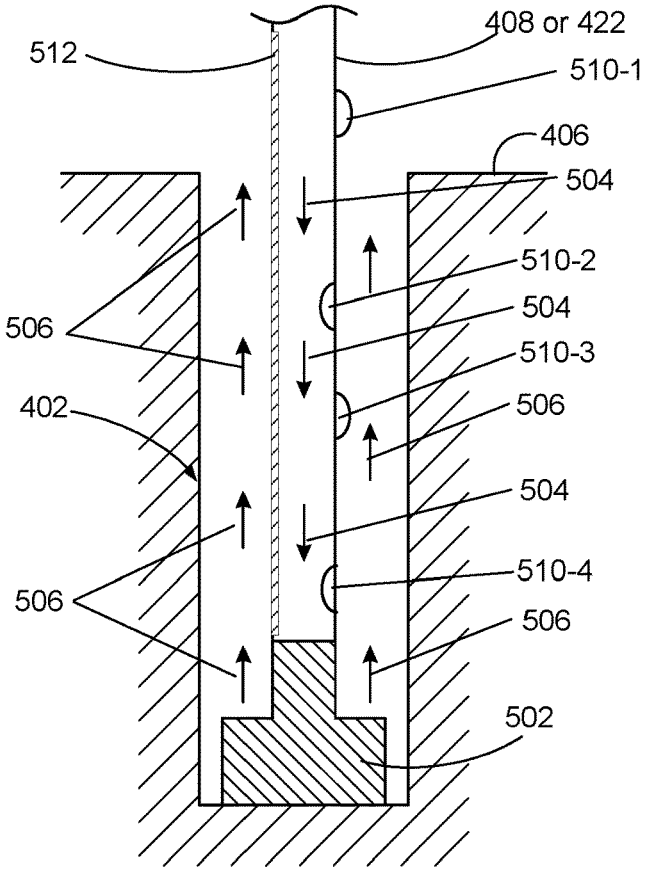
Figure 5B:
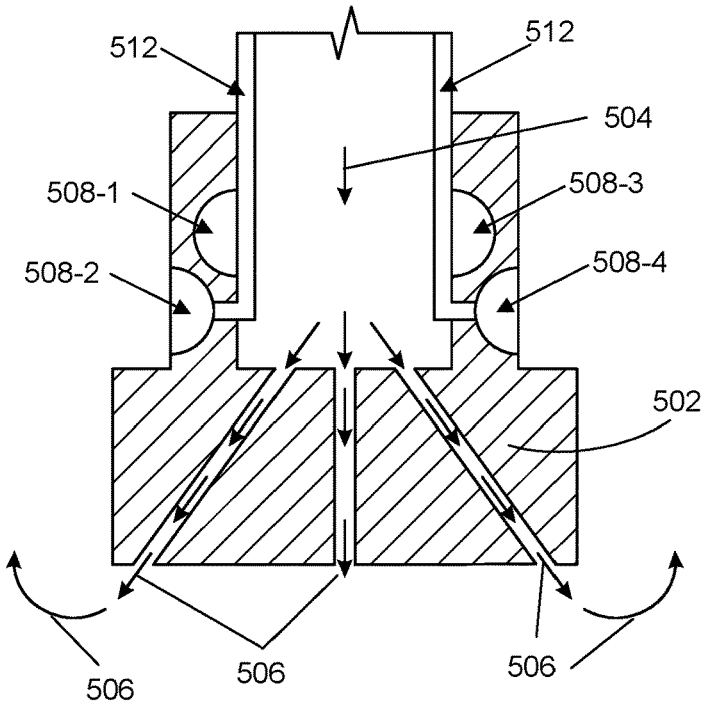

FIG. 5A illustrates a cross-sectional view that shows a drill bit 502 mounted on one end of a CT 408 and/or a joint pipe 422, to facilitate drilling of the geothermal boreholes. FIG. 5B illustrates a cross-sectional view of the drill bit 502 according to some embodiments. The drill bit 502 is rotated by a motor (not shown) that is hydraulically activated by pumping drilling fluid (e.g., water and/or bentonite) through the CT 408 or the joint pipes 422. The arrows 504 in FIGS. 5A and 5B indicate the direction of the drilling fluid as it is pumped through the CT 408 and/or a joint pipe 422. The arrows 506 in FIGS. 5A and 5B indicate the direction of drilling mud (e.g., water and/or bentonite and debris) as it exits the drill bit 502 and motor.

In some embodiments, the drill bit 502 includes sensors 508 (e.g., underground or downhole sensors) that are designed to measure underground parameters in-situ, as (e.g., during, while) the geothermal boreholes are being drilled/constructed. The underground parameters include temperature, pressure, humidity, lithology, azimuth, stresses, and/or depth correlation. In some embodiments, the sensors 508 collect downhole data having data types that are illustrated in FIG. 5E.

In some embodiments, the sensors 508 are positioned on both the interior surface and the exterior surface of the drill bit 502. For example, FIG. 5B illustrates four downhole sensors 508-1 to 508-4. The sensors 508-1 and 508-3 are positioned on the interior surface of the drill bit 502. The sensors 508-2 and 508-4 are positioned on the exterior surface of the drill bit 502.

In some embodiments, at least two of the sensors 508 have the same sensor type. As an example, the sensor 508-1 and the sensor 508-2 can both be temperature sensors. As another example, the sensor 508-1 and the sensor 508-3 can both be pressure sensors.

In some embodiments, the sensors 508 include two sensors having the same sensor type. One of the two sensors is positioned on the interior surface and the other of the two sensors is positioned on the exterior surface. For example, in FIG. 5B, both the sensor 508-1 and the sensor 508-2 can be temperature sensors. The positioning of temperature sensors on both the interior and exterior surface of the drill bit 502 enables one to determine the temperature of the drilling fluid (e.g., drilling mud) before it enters the drill bit 502 after it exits the drill bit 502. By knowing these temperature values, one can calculate (e.g., determine) parameters such as frictional forces and heat generated by the frictional forces (e.g., by applying relations such as mass-momentum conservation energy in pipes).

In some embodiments, the CT 408 and/or joint pipes 422 also include one or more sensors 510 (e.g., surface sensors) that can be positioned along (e.g., between) the surface 406 and a depth of the geothermal borehole 402. In some embodiments, the surface sensors 510 can be positioned on the surface 406, on the CT injector 410, on the reel 412, and/or anywhere on the truck 414. The surface sensors 510, such as the sensors 510-1 to 510-4 as shown in FIG. 5A, measure surface data in-situ, as the geothermal boreholes are being drilled/constructed. In some embodiments, the sensors 510 measure (e.g., collect) data such as fluid rate, pressure, temperature, and/or a length of the CT or joint pipe running into the borehole. In some embodiments, the sensors 510 collect surface data having data types that are illustrated in FIG. 5E.

In some embodiments, the sensors 510 are positioned on both the interior surface and the exterior surface along the CT 402/joint pipes 422.

In some embodiments, at least two of the sensors 510 have the same sensor type.

In some embodiments, the sensors 510 include two sensors having the same sensor type. One of the two sensors is positioned on the interior surface along the CT 402/joint pipes 422, and the other of the two sensors is positioned on the exterior surface along the CT 402/joint pipes 422.

FIG. 5E illustrates exemplary types of surface data and downhole data that are collected by the sensors 508 and the sensors 510 in accordance with some embodiments.

With continued reference to FIG. 5, in some embodiments, the underground data collected by the sensors 508 and/or the sensors 510 can be transferred to the surface (e.g., to the geothermal planning and optimization system 200) automatically and in real-time using telemetry wires 512. The telemetry wires 512 also transfer power from the surface to the sensors 508 and/or the sensors 510. In some embodiments, the telemetry wires 512 are associated with telemetry technologies such as electrical conduits or mud pulse telemetry, both of which are used for oil and gas CT operations. The electrical conduits (e.g., wires) have the dual advantage of being capable of much higher data transmission rates and being capable to also power to the underground sensors 508 (and to the surface sensors 510) from the surface. In the case of mud pulse telemetry, the underground sensors 508 would need to be powered by batteries, making the drill bits much bigger.

Figures 2, 5D:
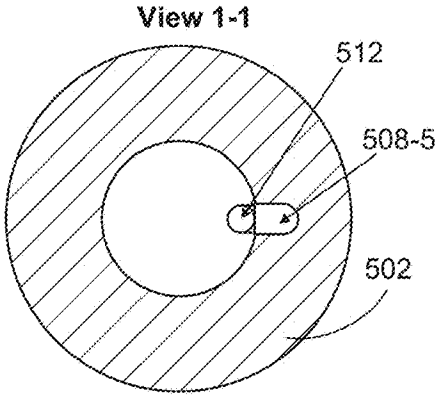
Figures 3, 5D:
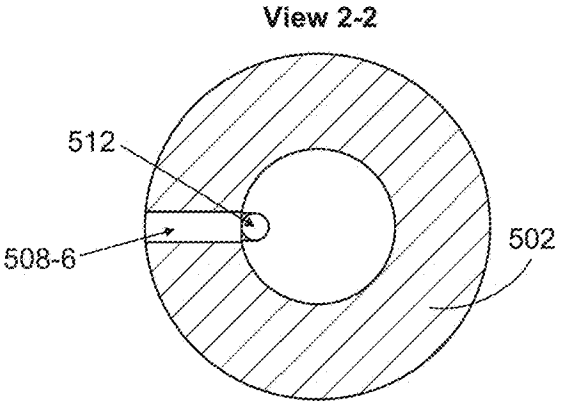
Figures 1, 5D:
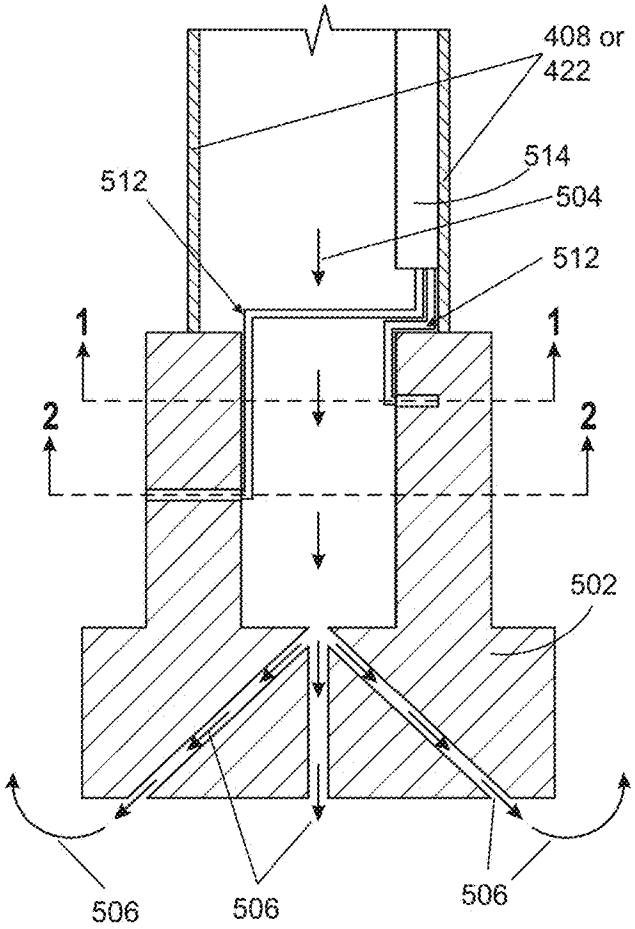
Figure 5C:
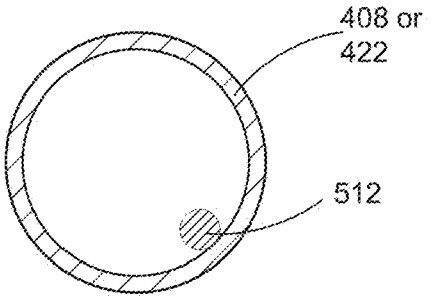

FIG. 5C is a cross-sectional view of a CT 408/joint pipe 422. In this example, the telemetry wire 512 is located on an internal wall (e.g., interior surface) of the CT 408/joint pipe 422.

FIG. 5D-I is a cross-sectional view of the CT 408/joint pipe 422 and the drill bit 502, showing positions of the telemetry wire 512, a telemetry tube 514, and the flow directions 504 and 506 of the drilling fluid/drilling mud. The view in direction 1-1, as illustrated in FIG. 5D-2, shows the telemetry wire 512 positioned on the interior surface of the drill bit 502. The view in direction 1-1 shown in FIG. 5D-2 also illustrates coupling (e.g., an electrical coupling, a communicative coupling) between the telemetry wire 512 and a sensor 508-5. In this example, the sensor 508-1 is an internal sensor (e.g., it is positioned on an interior surface of the drill bit 502). The view in direction 2-2, as depicted in FIG. 5D-3, illustrates coupling (e.g., an electrical coupling, a communicative coupling) between the telemetry wire 512 and a sensor 508-6-5. In this example, the sensor 508-6 is an external sensor (e.g., it is positioned on an exterior surface of the drill bit 502).

Figure 6A:
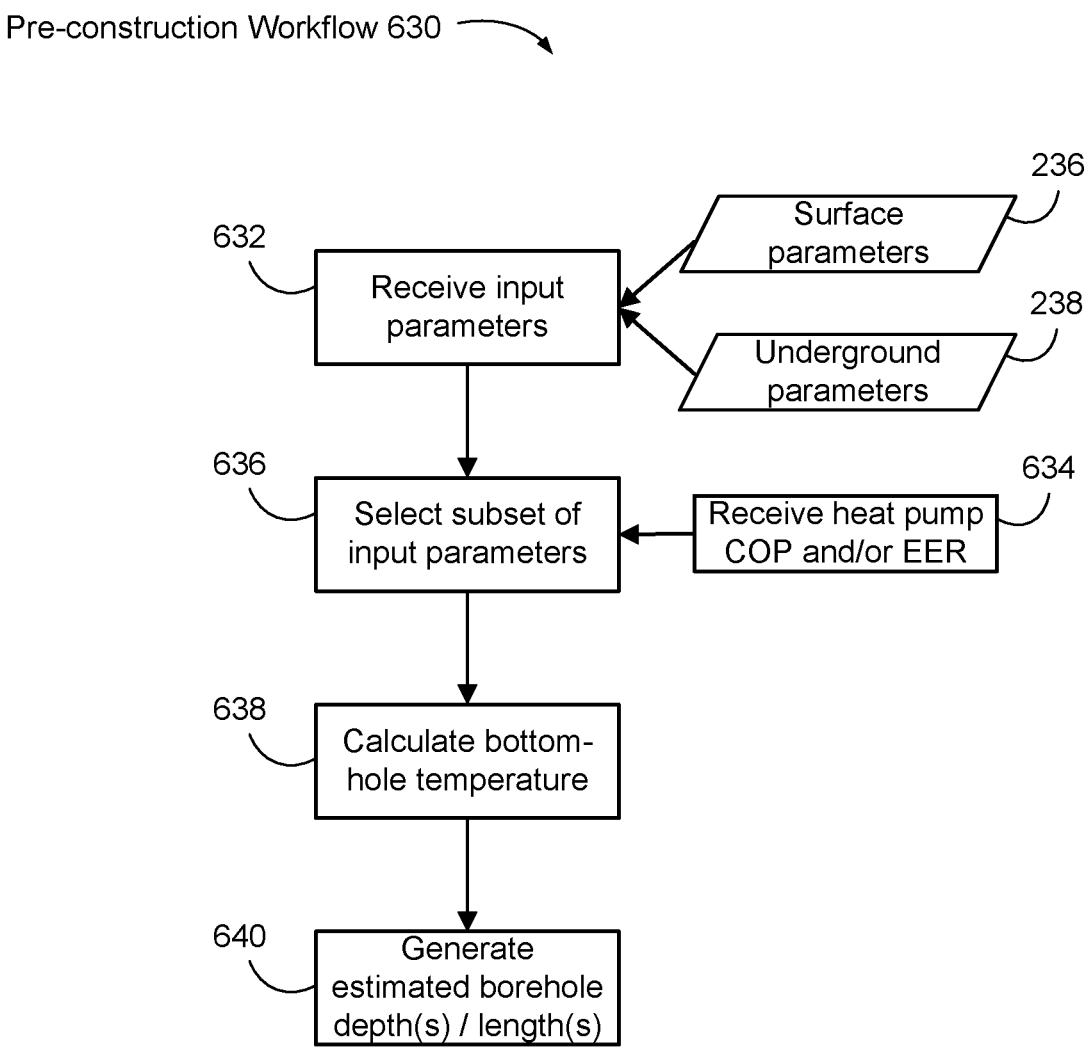
FIGS. 6A to 6C illustrate an integrated workflow for planning, constructing, and/or optimizing a GHCS operation, in accordance with some embodiments.
Figure 6B:
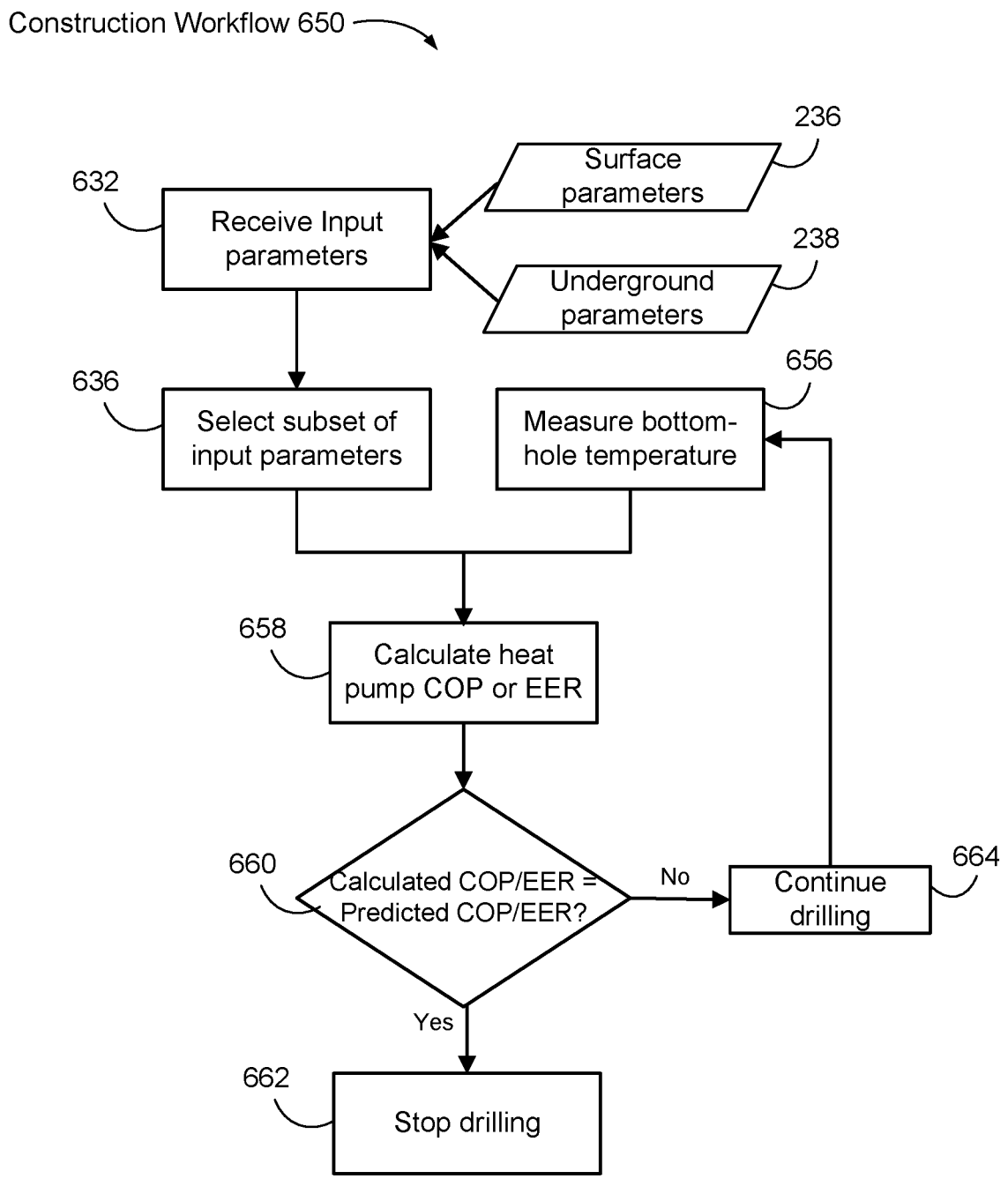
Figure 6C:
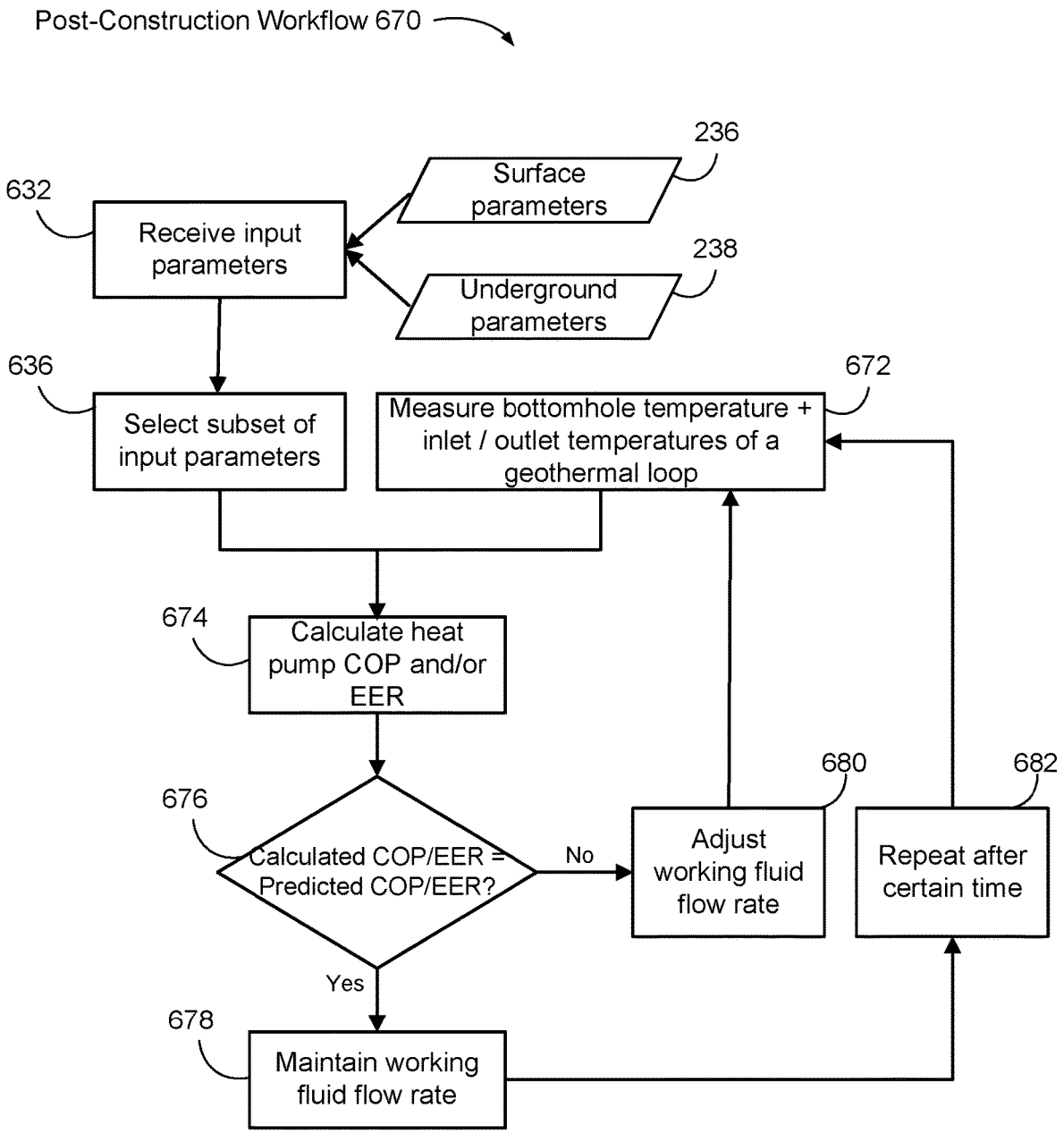

FIGS. 6A to 6C illustrate an integrated workflow (e.g., integrated workflow 628) for planning, constructing, and/or optimizing a GHCS operation, in accordance with some embodiments. In some embodiments, the workflow 628 includes a combination of one or more of: pre-construction workflow 630, a construction workflow 650, and a post-construction workflow 670. The workflows 630, 650, and 670 are executed by a processor (e.g., processor 202 or processor 302), in accordance with some embodiments. In some embodiments, each of the workflows 630, 650, and 670 can be executed as a standalone workflow.

FIG. 6A illustrates a pre-construction workflow 630 that is executed by a processor (e.g., processor 202 or processor 302) during a pre-construction phase of a GHCS operation, according to some embodiments.

The workflow 630 includes receiving (632) input parameters (e.g., specified by a user, the system 200, or the server 120). The input parameters can include surface parameters 236 and/or underground parameters 238. In some embodiments, the input parameters include default (e.g., pre-defined) values that can be modified and/or overridden by a user.

The workflow 630 includes receiving (634) (e.g., from a user) a heat pump COP for heating and/or EER for cooling. In some embodiments, the heat pump COP/EER comprises a manufacturing COP/EER of the heat pump as specified by the pump manufacturer. In some embodiments (e.g., for large buildings), two or more heat pumps that work in tandem or independently may be used. The workflow 630 includes receiving respective heat pump COPs/EERs corresponding to each of the two or more heat pumps. In some embodiments, in addition to (or instead of) receiving the heat pump COP/EER, the workflow can measure heat transfer (e.g., directly, by measuring a temperature difference in an object) or indirectly, by calculation) and use the measured heat transfer as a proxy for determining the COP/EER. For example, in some embodiments, the workflow 630 includes measuring (or receiving) one or more temperatures of a geothermal fluid, such as an inlet and/or an outlet temperature. In some embodiments, the workflow 630 includes measuring (or receiving) a heat transfer coefficient of the heat between a subsurface and a geothermal borehole.

The workflow 630 includes selecting (636) (e.g., by the processor), or receiving user selection of, a subset of input parameters. The workflow 630 includes calculating (638) a bottom-hole temperature of a geothermal borehole to be constructed, based on the selected subset of input parameters. The workflow 630 includes generating (640) (e.g., by the processor, by applying the model 126) estimated borehole parameters, such as the borehole depth, length, and/or diameter.

In some embodiments, in accordance with receiving the heat pump COP and/or EER in step 634, the processor generates a range of COP and/or EER values (e.g., by applying the model 126), to obtain a range of borehole parameters, which in turn facilitates a builder to properly design and plan the drilling job, obtain the right drilling permits, and/or for plan the geothermal loops for an optimal long-term underground heat transfer process.

In some embodiments, execution of the workflow 630 provides (e.g., generates) operational parameters of one geothermal borehole. In a construction that involves multiple boreholes, the workflow 630 is executed repeatedly, each of the iterations generating a set of borehole parameters for a respective borehole.

Figure 8A:
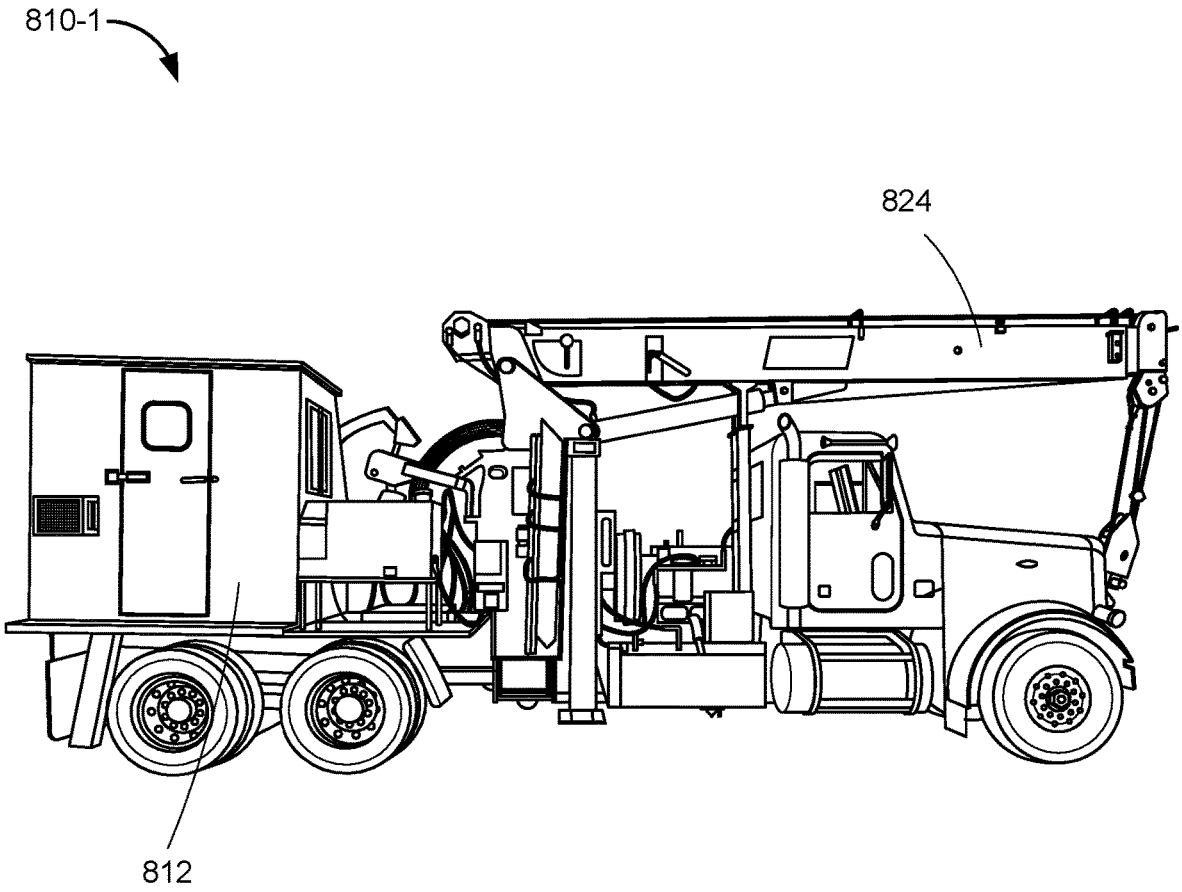
FIGS. 8A to 8E illustrate components of an ultra-compact coiled tubing unit (UCCTU), in accordance with some embodiments.

FIG. 6B illustrates a construction workflow 650 that is executed by a processor (e.g., processor 202 or processor 302) during the construction phase of a GHCS operation, according to some embodiments. In some embodiments, the workflow 650 includes the step 632 and the step 636 as described previously with respect to FIG. 8A.

In some embodiments, the workflow 650 includes, in step 656, measuring (e.g., by one or more sensors) the bottom-hole temperature of a geothermal borehole during the construction of the borehole. For example, as illustrated in FIGS. 5B, 5D-1, 5D-2, and 5D-3, sensors 508 can be mounted on a drill bit 502 that is used for drilling a geothermal borehole. In some embodiments, the sensors 508 include temperature sensors for measuring (e.g., automatically and in real time) a bottom-hole temperature as the geothermal borehole is being drilled. In some embodiments, the workflow 650 includes measuring surface and downhole conditions (e.g., pressure, temperature, and/or flow rate) during the construction of the borehole, from surface sensors (e.g., sensors 510) and underground sensors (e.g., sensors 508).

In some embodiments, the workflow 650 includes, in step 658, calculating (e.g., by the processor) the heat pump COP/EER based on the selected subset of input parameters and the measured bottom-hole temperature. For example, the processor updates the model 126 based on the measured bottom-hole temperature, and applies the updated model to determine a calculated (e.g., actual, modified) heat pump COP/EER.

In some embodiments, the workflow 650 includes comparing (660) the calculated COP/EER with a predicted COP/EER (e.g., predicted by the model 126 or a machine learning database 130). The workflow 650 includes, in step 662, terminating the drilling process when the calculated COP/EER matches the predicted COP. The workflow 650 includes, in step 644, continuing the drilling of the geothermal borehole (e.g., drilling deeper, varying a drilling angle and/or a borehole diameter) when the calculated COP/EER does not match the predicted COP/EER.

Stated another way, the downhole sensors (e.g., sensors 508) encased in the drill bit 502 allow re-calibration of the model 126 in real time. That is, actual temperature data is acquired in real time during drilling, which changes the output of initial design model dynamically. This empowers the field personnel to optimize the operational parameters on-the-fly, e.g., drilling shorter, longer, or wider wells to ensure the optimal performance of each GHCS installation.

FIG. 6C illustrates a post-construction workflow 670 that is executed by a processor (e.g., processor 202 or processor 302) during the post-construction phase of a GHCS operation, according to some embodiments. In some embodiments, the workflow 670 includes the step 632 and the step 636 as described previously with respect to FIG. 6A.

In some embodiments, the workflow 670 includes, in step 672, measuring the bottom-hole temperature (e.g., of a borehole or a geothermal loop) and an inlet/outlet temperature of a geothermal loop (e.g., geothermal loop 604). In some embodiments, after the geothermal borehole 402 has been constructed, an optical fiber is placed inside the constructed borehole, for collecting the temperature along a geothermal loop constructed based on the borehole. In some embodiments, the bottom-hole temperature is determined indirectly via calculations (e.g., solving a loop-pipe flow thermodynamic equation, or determining a temperature profile along the geothermal loop loop).

In some embodiments, the workflow 670 includes, in step 674, calculating a heat pump COP for heating and/or a heat pump EER for cooling. The workflow 670 includes. in step 676, comparing the calculated COP with a predicted COP/

EER (e.g., predicted by the model 126). The workflow 670 includes, in step 678, maintaining a current flow rate of a working fluid in the geothermal loop when the calculated COP/EER matches the predicted COP/EER. The workflow 670 includes, in step 680, adjusting the flow rate of the working fluid in the geothermal loop when the calculated COP/EER does not match the predicted COP/EER.

In some embodiments, the workflow 670 includes, in step 682, repeating the measuring and calculating (e.g., steps 672, 674, and 676) after a certain time (e.g., every month, every three months, every year, or every change of season), and maintaining or adjusting the flow rate of the working fluid accordingly.

In a geothermal system, heat exchange occurs (1) between the geothermal loop and the building and (2) between the geothermal loop and the near constant-temperature thermal reservoir from the underground rocks. The underground heat transfer process between the working fluid 606 and the underground rocks (e.g., the underground region surrounding the geothermal loop) can be calculated by solving a radial (i.e., one-dimensional) diffusion equation in the near-borehole region (e.g., 10 to 30 feet radially from the borehole). The initial temperature of the near-borehole region is different from the long-term pseudo-steady-state temperature of the same region. The temperature of the near-borehole region changes over time due to several reasons. First, for heating, the working fluid picks up heat from the underground rocks and brings it to the surface, so the inlet temperature of the geothermal loop (see, e.g., FIG. 7) is lower than the outlet temperature of the geothermal loop. If the fluid is continuously circulated, heat is produced from the underground, so the temperature in the near-borehole region decreases over time until it reaches a pseudo-steady-state temperature, which is lower than the initial underground temperature. On the other hand, for cooling, the working fluid loses heat to the underground rocks, so the inlet temperature of the geothermal loop is higher than the outlet temperature of the geothermal loop. If the fluid is continuously circulated, heat is lost to the underground, so the temperature in the near-borehole region increases over time until it reaches a pseudo-steady-state temperature, which is higher than the initial underground temperature. Stated another way, because the pseudo-steady-state temperature of the near-borehole region is expected to vary from the initial temperature when the geothermal loop is first installed, the working fluid flow rate may need to be adjusted over time to ensure optimal long-term performance of the GHCS.

Figure 7:
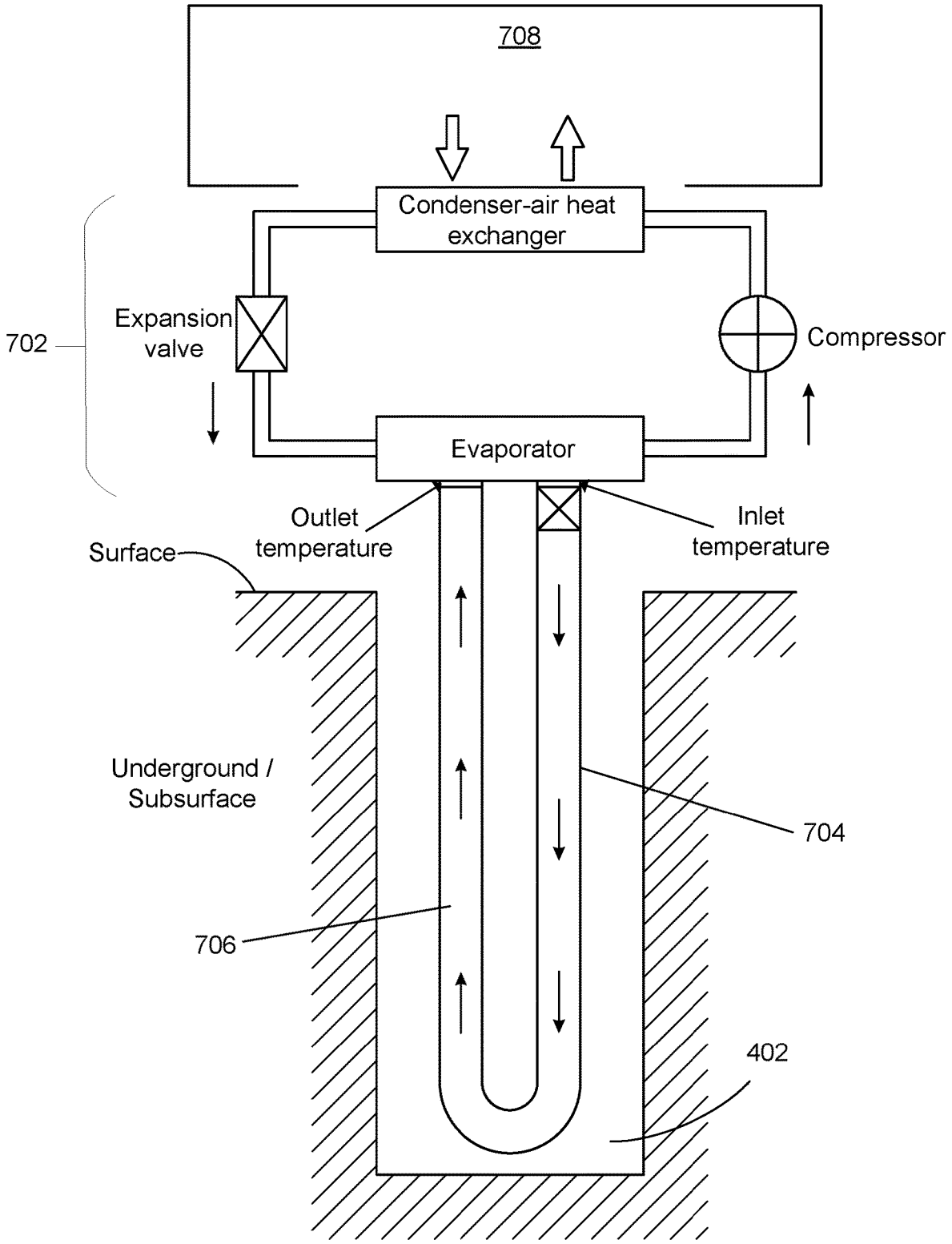
FIG. 7 illustrates a heat pump and a geothermal loop in accordance with some embodiments.

FIG. 7 illustrates a heat pump 702 and a geothermal loop 704 in accordance with some embodiments. In some embodiments, the geothermal loop 704 is constructed from a geothermal borehole 402. The geothermal loop 704 comprises a pipe that is made of a material such as high-density polyethylene (HDPE), fiberglass or carbon steel. The geothermal loop 704 can be installed as a U-loop into a borehole 402 and connected to a heat pump 702 of a building 708. The heat pump 702 uses the nearly constant temperature underground to heat or cool the interior of a building 708. The geothermal loop 704 is filled with a fluid 706 (e.g., a working fluid, such as a refrigerant) that circulates inside the geothermal loop 704. In summer, the surface air has a higher temperature compared to the underground temperature. The fluid 706 absorbs heat from the surface and releases it underground. In winter, the surface air has a lower temperature compared to the underground temperature. The fluid 706 absorbs heat from the underground and releases it to the surface. In some embodiments, the heat pump 702 includes a reversing valve, which lets the heat pump 702 switch directions to either heat or cool the building.

A. Ultra-Compact Coiled Tubing (UCCT) Operations for Geothermal Well Construction Some aspects of the present disclosure are directed to coiled tubing (CT) drilling technology for constructing geothermal wells.

Current drilling technologies for geothermal and hydrocarbon well construction are divided between (Category A) small drilling rigs for shallow water or geothermal wells (e.g., 100 to 400 feet long vertical (e.g., deep) wells, and (Category B) large drilling rigs for deep oil & gas and conventional geothermal wells (e.g., 10,000 to 30,000 feet long vertical wells). No off-the-shelf drilling rig exists commercially for mid-range-length wells that are between 500 and 10,000 feet deep. Therefore, no off-the-shelf drilling rig has been developed for this range, leaving a technology gap between Categories A and B. While shallow water well drilling rigs (Category A) are small and portable enough to be transported and operated in high-density urban areas, they do not go very deep and are not very fast. The deep oil and gas rigs (Category B) are fast and powerful, but also large and heavy, and are meant to operate in remote areas far from urban/suburban development. This leaves a gap for fast and strong, yet compact and portable drilling rigs that can operate in urban/suburban/rural areas.

In addition to the technology gap for mid-range length geothermal wells, several constraints exist when it comes to constructing geothermal boreholes in urban (e.g., high-density), suburban, and, or commercial areas. For example, the vehicle(s) transporting the construction equipment must satisfy the space and/or weight limitations imposed by the areas where the construction will be carried out. The drill rig and other construction equipment need to be transported to and from the construction site via paved concrete roads. Furthermore, any noise generated during well construction must be within the noise level imposed by these areas.

Coiled tubing has historically been an oil and gas supporting technology and is used primary for well interventions. Coiled tubing is versatile in terms of equipment, pipe size and configuration, fluids used, tools conveyance, and interaction with the reservoir. Its applicability and value for hydrocarbon production are vastly documented, from drilling and completions to production enhancement and well abandonment.

Despite its strengths, coiled tubing is not currently used in shallow (e.g., up to 1,000 feet) or mid-range (e.g., around 500 feet to 3,000 feet) drilling, nor has there been any attempt to utilize coiled tubing for geothermal loop insertion or grouting.

Some embodiments of the present disclosure are directed to an ultra-compact coiled tubing unit (UCCTU) for geothermal field construction. The UCCTU includes coiled tubing that can be employed for multiple phases of a geothermal field construction process, including a drilling phase, and/or a geothermal loop insertion phase, and/or a grouting phase. The UCCTU is designed and built considering inner-city weight, width, length, and height limitations, and can be deployed for geothermal drilling in dense urban areas, for decarbonizing buildings and reducing their dependance on the electrical grid.

According to some embodiments, the UCCTU disclosed herein fills the technology void for mid-range-length wells that are between ~500 feet and ~3,000 feet deep.

The present disclosure advantageously improves upon current geothermal well construction processes in several ways. First, the current practice of manually inserting geothermal loops into boreholes is difficult and physically demanding. The task becomes even more challenging when the well depths are~800 feet and upwards. The challenge is exacerbated when groundwater is present, or when boreholes are not straight. The risk of geothermal loops getting stuck in the lateral borehole walls or pushed back by buoyancy is quite high, and limits the ability to install them to greater depths. Utilizing coiled tubing for geothermal loop insertion makes the process easier, faster, and more efficient. Coiled tubing can be driven into the ground using the injector. The driving force provided to the CT by the injector is large enough to push geothermal loops to depths unheard of by the current shallow geothermal drilling industry. Second, the industry currently uses Tremie lines for the grouting phase. Because grout is a viscous paste, pumping grout through one-inch-diameter tremie lines at depths greater than ~500 to 600 feet is operationally impossible.

1. Ultra-Compact Coiled Tubing Unit (UCCTU)

FIGS. 8A-8E and 10 illustrate components of an ultra-compact coiled tubing unit UCCTU 800 for geothermal field construction, in accordance with some embodiments.

As used herein, a geothermal field refers to a set of (e.g., one or more) boreholes, a set of (e.g., one or more) geothermal loops connected to a building, and the rock volume surrounding the set of geothermal loops. In some embodiments, a geothermal field can refer to the entire set of boreholes and geothermal loops connected to a building, and the rock volume surrounding all the geothermal loops.

In this disclosure, the term "geothermal field" is used interchangeably with the term "geo-field."

A geothermal loop (e.g., also described in FIG. 7) is constructed from a geothermal borehole. The geothermal loop can be a pipe or a long tube that is made of a material such as high-density polyethylene (HDPE), fiberglass or carbon steel. In some embodiments, the geothermal loop is installed as a U-loop into a borehole and connected to a heat pump of a building. Water or refrigerant (e.g., glycol) is flowing continuously through the geo-loop exchanging heat between the building and the subsurface rocks.

In this disclosure, the term "geothermal loop" is used interchangeably with the term "geo-loop."

The UCCTU 800 can include multiple pieces of equipment that are modular in nature. In some embodiments, all the equipment of the UCCTU 800 can be installed and transported on one, two, or three or more chassis and skids (metal frames for supporting equipment) of a vehicle, such as vehicle 810-1 in FIG. 8A or vehicle 810-2 in FIG. 8B. In some embodiments, the number of pieces of the equipment and/or their sizes and operating capacities can be scaled depending on the geothermal field to be constructed.

In some embodiments, the UCCTU 800 includes a control cabin 812, which contains all of the necessary controls for operating the UCCTU.

In some embodiments, the UCCTU 800 includes a wet kit 814, which is a hydraulic component that uses a power take-off (PTO) to power functions.

In some embodiments, the UCCTU 800 includes a coiled tubing (CT) reel 816 for spooling and unspooling coiled tubing (CT) 818. The CT 818 is also referred to as a CT string (or a pipe). CT 818 is a continuous length of metal or composite tubing with no joints. The length of the CT 818 can be predefined according to a depth of geothermal borehole to be constructed (e.g., drilled). For example, the length of CT 818 can be 500 feet, 2000 feet, or 4000 feet, or 10,000 feet (e.g., within ±2%, ±5%, or ±10%). In some embodiments, CT 818 comprises a low-alloy carbon steel tubing. In some embodiments, the CT reel 816 is configured to be movable (e.g., with respect to its axle). For example, when the vehicle 810-1 or the vehicle 820 is parked at a site, the injector 820 and the CT reel 816 can be moved to different locations, within the site, to facilitate drilling of multiple geothermal boreholes while the vehicle remains stationary.

An injector 820 (also referred to herein as a CT injector or an injector head) injects one end of the CT 810 from the surface into a subsurface to construct a geothermal borehole. For example, the injector 820 is hydraulically powered and provides the surface drive force to run CT 810 underground to drill/construct a geothermal borehole (e.g., a geothermal well), and retrieves CT 810 out of a geothermal borehole after the drilling is completed.

The injector 820 includes a gooseneck 819 (e.g., an arch) for guiding the CT 818 into a body of the injector 820. In some embodiments, the gooseneck 819 is coupled to (e.g., attached to) the injector 820 at a fixed position, meaning that the gooseneck 819 is not adjustable. In some embodiments, the gooseneck 819 is adjustably coupled to the injector 820. In some embodiments, the gooseneck 819 is detachable from the injector 820. In some embodiments, goosenecks of different sizes can be attached to the injector 820 (e.g., depending on the space available for drilling).

For borehole construction, a drilling motor and a drill bit (e.g., drill bit 502) can be installed on (or proximate to) the end of the CT 818 that is be injected into the subsurface. In some embodiments, a drilling hammer, a steering tool and/or centralizers can be fitted the CT 818 for the borehole construction. The drilling hammer increases the push force applied on rocks during drilling, while the steering tool and/or centralizers keep the drilling as close to a straight line as possible.

Figure 11:
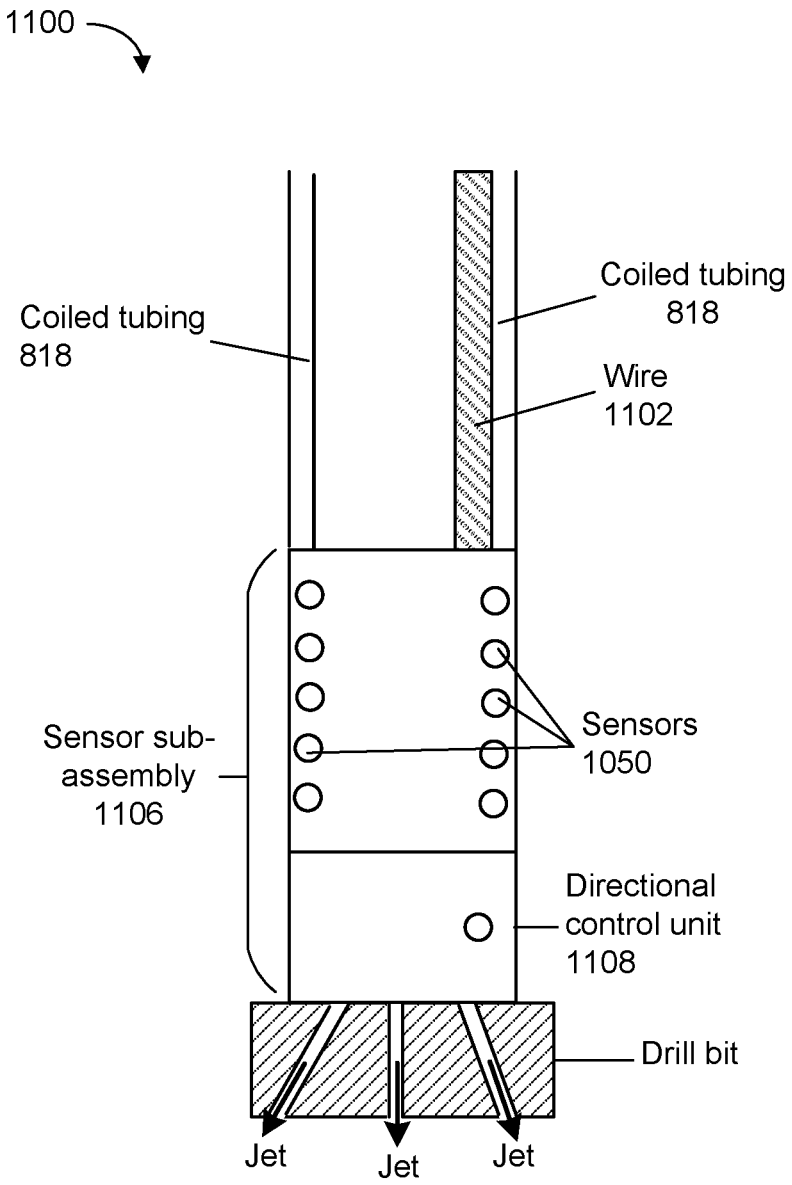
FIG. 11 illustrates a downhole telemetry system in accordance with some embodiments.

In some embodiments, CT 818 includes downhole telemetry (e.g., wired or wireless), which is discussed in further detail in FIG. 11.

In some embodiments, one or more sensors (e.g., sensors 508 or sensors 1015), such as pressure sensors, temperature sensors, gamma ray sensors, inclination/azimuth sensors, vibration sensors, acceleration sensors, force sensors, torque sensors, pH sensors, salinity sensors, and/or thermal conductivity sensors, are also installed above or below the motor.

In some embodiments, the UCCTU 800 includes one or more cranes 824 for lifting and moving components of the UCCTU.

In some embodiments, the UCCTU 800 includes a stripper 822. The stripper 822 provides a pressure seal around a coiled tubing unit when it is being run into or pulled out of a live well. The sealing mechanism is activated by hydraulic pressure and is controlled by an operator.

In some embodiments, the UCCTU 800 includes a fluid pump 826, a solids separation management equipment or mud recycler 828, a geothermal loop reel 830 for spooling geothermal loop 1220 (see, e.g., FIG. 13), grouting equipment 832, and/or a mixing tank 834. The mud recycler 828 separates (e.g., filters) the cuttings from the returning drilling mud before re-pumping the mud into the well to bring new cuttings to surface. The mixing tank 834 is a tank used for mixing drilling mud and additives (e.g., clay stabilizers, salts, or anti-corrosion inhibitors) or for producing grout by mixing water and grout powder.

Figure 8B:
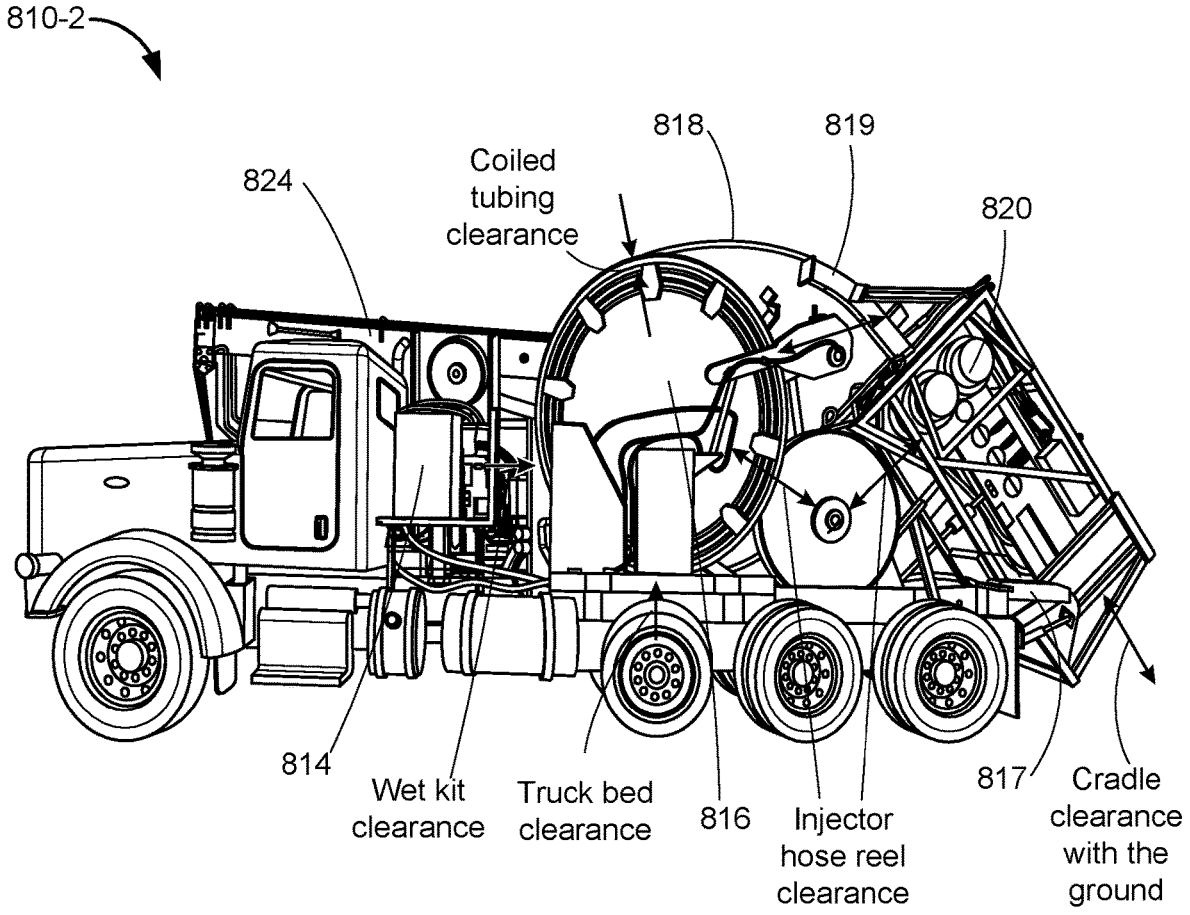
Figure 8C:
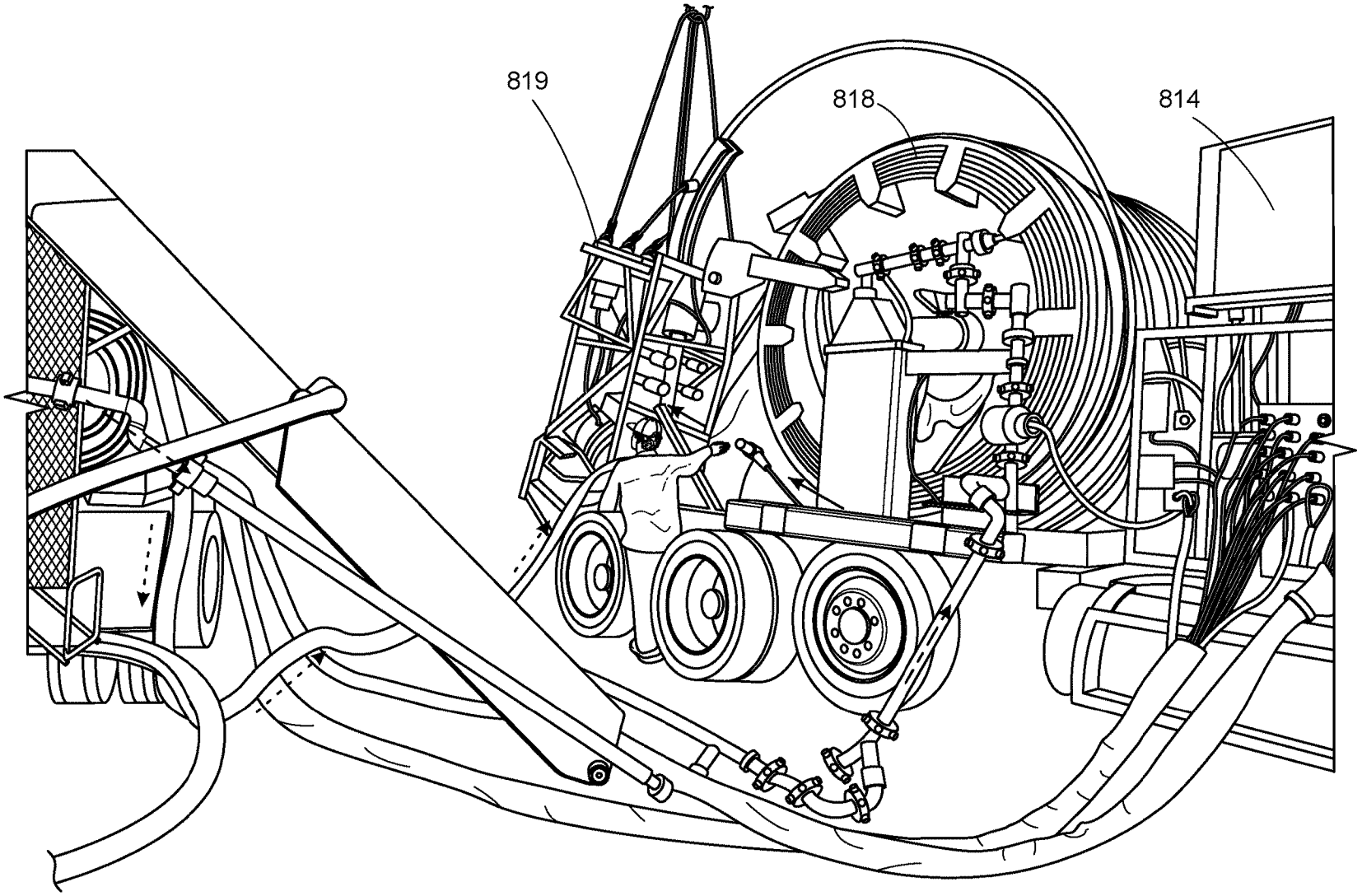
Figure 8D:
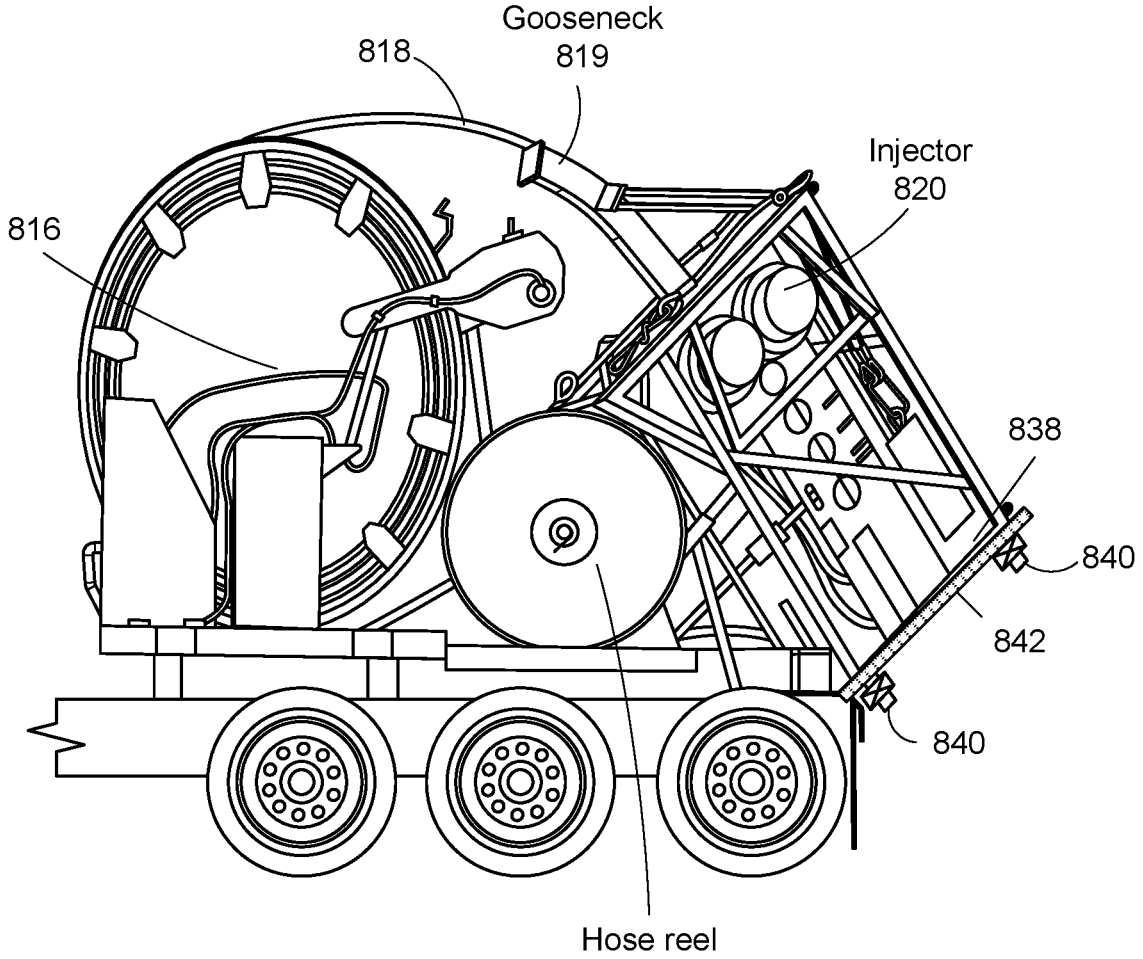

FIG. 8B shows that in some embodiments, the injector 820 is housed in a cradle 817 for transport by vehicle 802. In some embodiments, and as illustrated in FIG. 8C, the cradle 817 is removed and the injector is supported by forks 842 (e.g., extending from both sides of the truck) at stand 838 (e.g., injector stand). The stand 838 is used for supporting the injector 820 while the injector 820 is in operation.

Figure 8E:
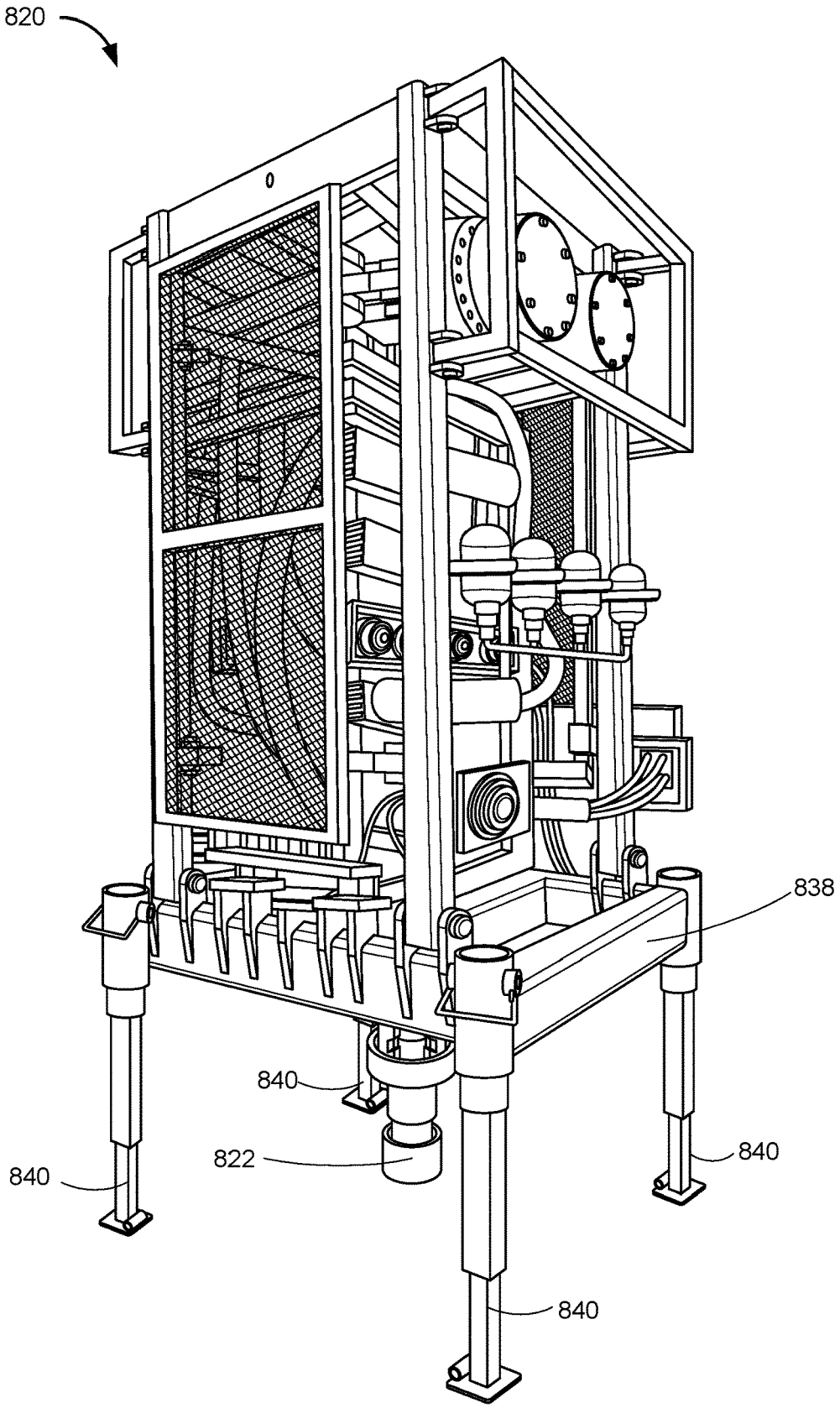

FIG. 8E illustrates an injector 820 in accordance with some embodiments. The injector 820 is mounted on a stand 838. The stand 838 includes hydraulically actuated (e.g., telescopic) legs 840. In some embodiments, the stand 838 and the stripper 822 are attached to the injector 820 during operation as well as transport (e.g., the entire time). The legs 840 can be configured (e.g., programmed) to control the drilling inclination of boreholes. For example, if the downhole telemetry data (e.g., obtained by sensors 1015) indicates that a borehole is drilled vertically (i.e., not inclined), the legs 840 are hydraulically actuated so that the injector 820 positioned horizontally. If the downhole telemetry data indicates that the borehole is drilled at an angle that is offset from the vertical (e.g., the borehole is inclined/tilted/not vertical), the legs 840 can be programmed to tilt the injector at (e.g., to the angle) so that a subsequent trajectory of the borehole is vertical.

In some embodiments, at the start of borehole drilling, the legs 840 can be hydraulically actuated to tilt the injector 820 such that the initial drilling angle is tilted (e.g., inclined) with respect to a vertical axis (e.g., because less force is required to drill at an oblique angle than at 90 degrees). During drilling, the legs 840 can be hydraulically actuated to steer to the drilling angle to be parallel to the vertical axis, and reduce clearance between the injector and the ground.

In some embodiments, the UCCTU 800 includes downhole tools 836, which can include any combination of one or more drilling motors, drill bits, fluid hammers, steering tools, centralizers, and/or washing nozzles.

Figure 9:
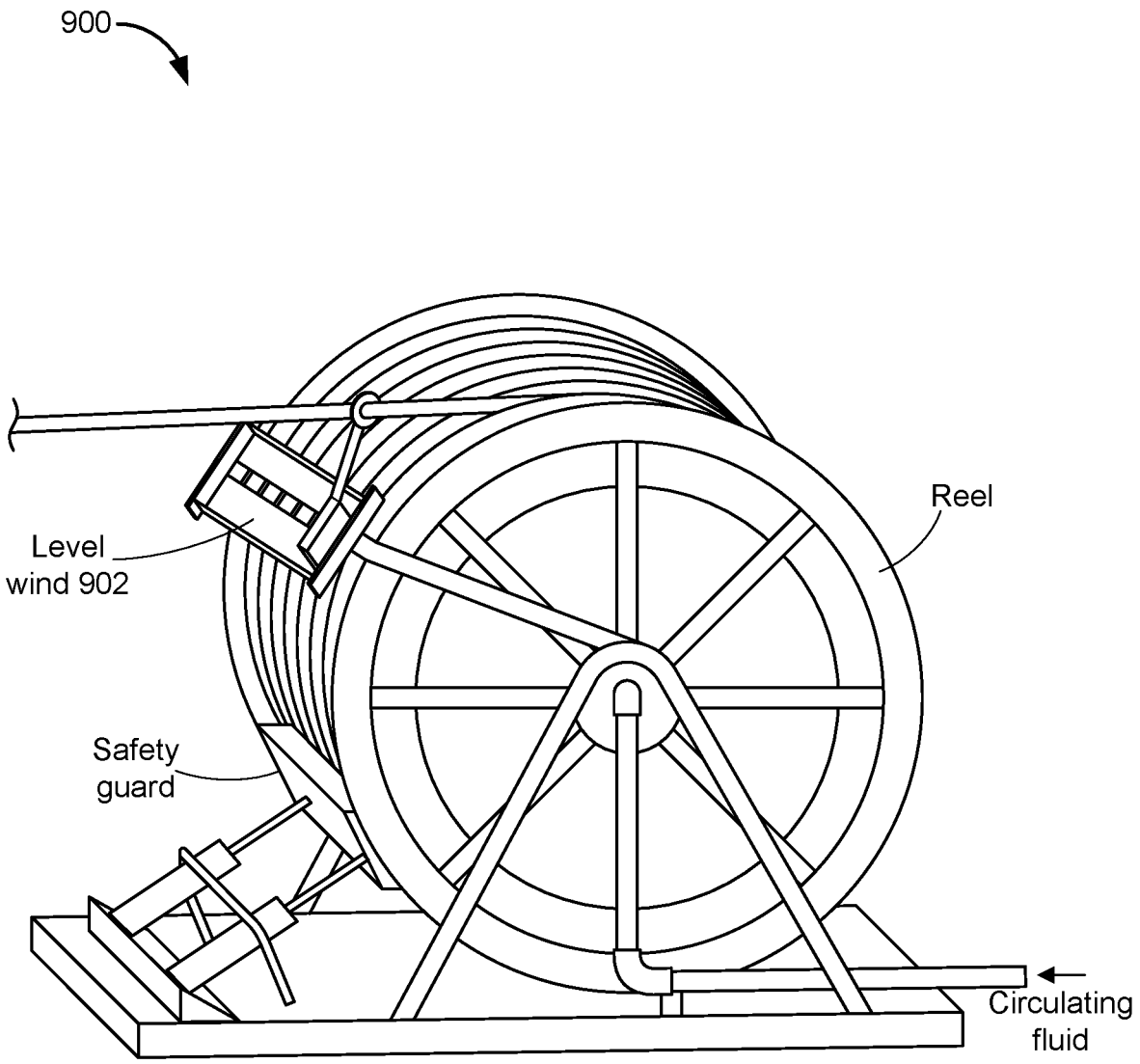
Figure 9 (PRIOR ART)
FIG. 9 illustrates a coiled tubing reel in prior art systems.

FIG. 9 illustrates a coiled tubing reel 900 that is found on existing systems. As discussed above, the injector includes a gooseneck for guiding the coiled tubing into a body of the injector. In existing systems, the gooseneck is fixed (i.e., not movable) on the injector. Because the reel is large and the distance between the reel and the injector is small (e.g., about 5-25 feet), reels of existing systems, such as the one shown in FIG. 9, has a level-wind 902 that guides the coiled tubing onto the drum. The level-wind can move left and right, following the unspooling and spooling of the coiled tubing, and is prone to frequent mechanical failures.

In some embodiments disclosed herein, the CT reel 816 eliminates the use of a level-wind. Instead, the gooseneck 819 is modified so that it is capable of rotating to follow the coiled tubing misalignment. In other words, instead of using a level-wind to force the coiled tubing to align over a short distance between the level-wind and gooseneck, some embodiments of the present disclosure employs a rotating gooseneck 819 with no level-wind for aligning the CT 818. In some embodiments, the gooseneck 819 can be reinforced with a telescopic arm with a ball (e.g., a ball and socket joint) to ensure that the gooseneck 819 is only moving laterally.

In accordance with some embodiments of the present disclosure, the UCCTU is designed and built to be within size and weight limits for vehicles and/or loads moving within cities. The UCCTU 800 can be deployed for geothermal drilling in dense urban areas, for decarbonizing buildings and reducing their dependance on the electrical grid.

Figure 10:
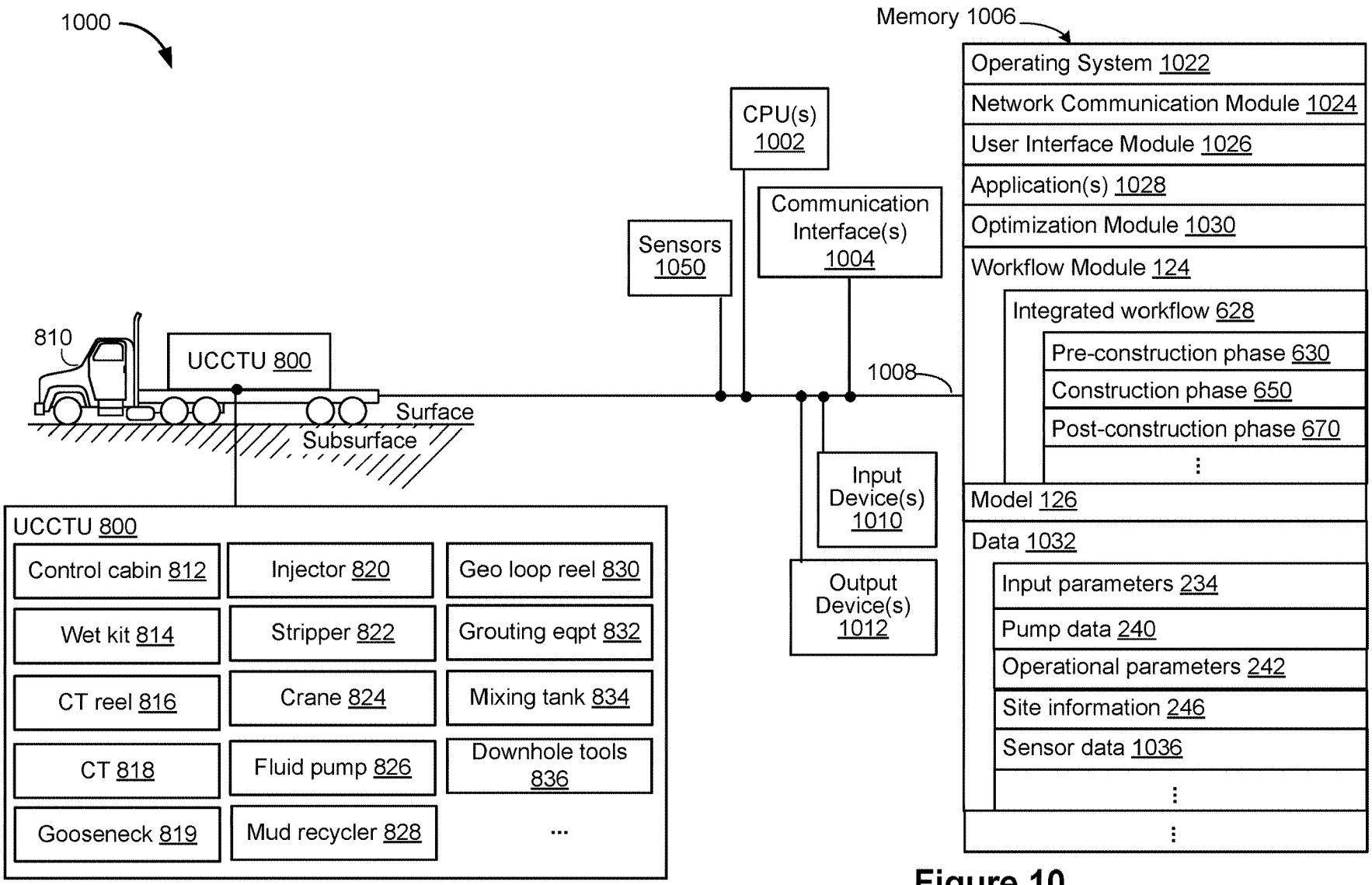
FIG. 10 illustrates a block diagram of a system for constructing geothermal loops, according to some embodiments.

FIG. 10 illustrates a block diagram of a system 1000 for geothermal field construction, in accordance with some embodiments.

In some embodiments, the system 1000 can include at least a subset of the components of the UCCTU 800.

In some embodiments, the system 1000 includes one or more processors (e.g., processing units, processing circuitry, electrical processing circuitry, hydraulic circuitry, signal processing circuitry, or CPUs) 1002, one or more network or other communication interfaces 1004, memory 1006, and one or more communication buses 1008 for interconnecting these components. In some embodiments, the communication buses 1008 include circuitry (sometimes called a chipset) that interconnects and controls communications between system components.

In some embodiments, the system 1000 is communicatively connected to one or more sensors 1050. The sensors 1050 can include one or more of: a force sensor, a torque sensor, a vibration sensor, an acceleration sensor, a gamma ray sensor, a temperature sensor, a pressure sensor, a pH sensor, and/or an azimuth/orientation sensor. There can be multiple sensors for each sensor type.

In some embodiments, the sensors are positioned on a drill bit of a CT and/or a joint pipe (e.g., as described in FIGS. 4 and 5). In some embodiments, drill bit and sensors 1050 are part of a telemetry system 1100 that is described with respect to FIG. 11.

In some embodiments, the system 1000 includes one or more input devices 1010 that facilitate user input, such as a keyboard, a mouse, a voice-command input unit or microphone, a touch screen display, a touch-sensitive input pad, a gesture capturing camera, or other input buttons or controls. In some embodiments, the system 1000 includes one or more cameras or scanners for capturing data. The system 1000 also includes one or more output devices 1012 that enable presentation of user interfaces and display content, including one or more speakers and/or one or more visual displays.

In some embodiments, the memory 1006 includes high-speed random access memory, such as DRAM, SRAM, DDR RAM, or other random access solid state memory devices; and, optionally, includes non-volatile memory, such as one or more magnetic disk storage devices, one or more optical disk storage devices, one or more flash memory devices, or one or more other non-volatile solid state storage devices. In some embodiments, the memory 1006 includes one or more storage devices remotely located from one or more processing units 1002. The memory 1006, or alternatively the non-volatile memory device(s) within the memory 1006, includes a non-transitory computer-readable storage medium. In some embodiments, the memory 1006 or the computer-readable storage medium of the memory 1006 stores the following programs, modules, and data structures, or a subset or superset thereof:

- an operating system 1022, including procedures for handling various basic system services and for performing hardware dependent tasks;
- a communications module 1024, which is used for connecting the UCCTU 800 to other systems, computers and devices via the one or more communication interfaces 1004 (wired or wireless), such as the communication network(s), Internet, other wide area networks, local area networks, metropolitan area networks, and so on;
- a user interface module 1026, which enables presentation of information (e.g., a graphical user interface for application(s) 1028, widgets, websites and web pages thereof, and/or audio and/or video content, text, etc.) at the system 1000 via one or more output devices 1012 (e.g., displays, speakers, etc.);
- one or more user applications 1028, which are executed by the system 1000 (e.g., web or non-web based applications for controlling another system, electronic device, or sensors, or for reviewing data captured by such devices);

an optimization module 1030, for determining operational parameters on the UCCTU 800 (e.g., the CT 818) in accordance with downhole telemetry data obtained by the sensors 508 and/or 1050;

workflow module 124, which is described with respect to FIGS. 2, 6A, 6B, and 6C;

model 126;

data 1032, including, for example:

input parameters 234;

pump data 240;

operational parameters 242;

site information 246; and/or sensor data 1036 (e.g., sensor data 244), which includes data obtained by sensors 508, 1050, and/or sensor data 244. The sensor data can include pressure, temperature, depth correlation and azimuth, rock hardness, pumping rates, force, torque, pH, and/or vibration data.

Although FIG. 10 shows a system 1000, FIG. 10 is intended more as a functional description of the various features that may be present rather than as a structural schematic of the implementations described herein. In practice, and as recognized by those of ordinary skill in the art, items shown separately could be combined and some items could be separated.

Each of the above identified executable modules, applications, or sets of procedures may be stored in one or more of the memory devices, and corresponds to a set of instructions for performing a function described above. The above identified modules or programs (i.e., sets of instructions) need not be implemented as separate software programs, procedures, or modules, and thus various subsets of these modules may be combined or otherwise re-arranged in various implementations. In some embodiments, the memory 1006 stores a subset of the modules and data structures identified above. Furthermore, the memory 1006 may store additional modules or data structures not described above (e.g., module(s) for machine learning and/or training models). In some embodiments, a subset of the programs, modules, and/or data stored in the memory 1006 are stored on and/or executed by a server system (e.g., server system 120).

In some embodiments, the system 1000 deploys a CT enabled drill bit and collects (e.g., in real time during the constructing) sensor data from sensors (e.g., sensors 1050, FIG. 10) that are positioned on the drill bit and at the surface. In some embodiments, the sensors 1050 are part of a downhole telemetry assembly 1100. In some embodiments, the drill bit is part of the downhole telemetry assembly 1100.

In some embodiments, the system 1000 uses the sensor data to determine (e.g., monitor) the drilling speed, the drilling force, and/or the drilling torque (e.g., the force and/or torque exerted on the drill bit). For example, the system 1000 can determine the force/torque on the CT 818 as it enters the injector, when it leaves the injector, and/or when it is injected into the subsurface. Additional details are described in U.S. patent Ser. No. 17/976,445, which is incorporated by reference herein in its entirety.

2. Downhole Telemetry System

FIG. 11 illustrates a downhole telemetry system (e.g., downhole telemetry assembly) 1100, in accordance with some embodiments.

The telemetry system 1100 includes a wire 1102 (e.g., telemetry wire). In some embodiments, the wire 1102 is used for transferring power from the surface to the sensors. In some embodiments, underground data (e.g., downhole telemetry data) collected by the sensors 1050 (e.g., sensor sub-assembly 1106) can be transferred to the surface automatically in real-time using the wire 1102.

The telemetry system 1100 includes a sensor sub-assembly 1106. In some embodiments, the sensor sub-assembly 1106 includes a directional control unit 1108 for controlling a drilling direction using data measured from an array of sensors 1104. In some embodiments, the directional control unit 1108 is hydraulically activated. In some embodiments, the directional control unit 1108 is electrically activated.

The sensor sub-assembly 1106 includes sensors 1050. The sensors 1050 can include one or more pressure sensors, one or more temperature sensors, one or more gamma ray sensors, one or more inclination sensors, one or more vibration sensors, one or more acceleration sensors, one or more force sensors, one or more torque sensors, one or more pH sensors, one or more salinity sensors, and/or one or more thermal conductivity sensors.

In some embodiments, the sensors 1050 are downhole sensors that measure subsurface sensor data. The sensors 1050 are positioned on both an interior surface and the exterior surface of the sensor sub-assembly 1106.

In some embodiments, the system 1000 includes surface sensors that are located on above the ground, for collecting surface sensor data.

In some embodiments, the sensors 1050 include a first downhole temperature sensor that is positioned internal to the sensor sub-assembly 1106 and a second downhole temperature sensor that is positioned external to (e.g., facing the subsurface) the sensor sub-assembly 1106. The combination of the first and second downhole temperature sensors are used to determine a geothermal gradient while drilling.

In some embodiments, the sensors 1050 include inclination and/or azimuth sensor(s) for determine whether lateral drift (e.g., a distance between an actual borehole distance and a planned trajectory) while drilling. The lateral drift can be a displacement in a horizontal plane, in any direction, assuming that the borehole is vertical. In some embodiments, the lateral drift is a distance between an actual borehole distance and a planned trajectory, measured with respect to a plane perpendicular to the borehole axis.

In some embodiments, data collected from the downhole sensors 1050 is used for determining whether a geothermal loop is installed at target depth and/or grout is filling the borehole entirely.

In some embodiments, the sensors 1050 are arranged in an array. For example, in some embodiments, the sensors are arranged with a geometric pattern so as to be able to measure geological data (e.g., rock data) in three dimensions (e.g., directionally radial data).

In some embodiments, the sensors 1050 are positioned on the exterior surface of the drill bit or in/on the telemetry sub-assembly located between the drill bit and a CT connector. For example, the sensors that are positioned on the exterior surface of the drill bit can include: a force sensor, a torque sensor, a pressure sensor, a temperature sensor, a vibration sensor, a pH, a gamma ray sensor, and/or an azimuth/orientation sensor.

In some embodiments, the sensor sub-assembly (e.g., the telemetry system) uses force and/or vibration data obtained (e.g., measured) by the force and/or vibration sensors, to calibrate the data measured by the other sensors (e.g., pressure data, temperature data, etc.) based on the measured vibrations. Without this calibration, the data can be noisy.

In accordance with some embodiments, the telemetry system 1100 disclosed herein advantageously improves geothermal field construction. For example, a requirement for current drillers (e.g., in a city) is that they have to map/verify that the constructed boreholes are vertical. Because current geothermal borehole construction technologies do not incorporate built-in sensors, the industry practice is to drill about 100 feet every time, insert a wireline (e.g., a wire with sensors) to measure and confirm that the geothermal borehole is (e.g., still) in the direction the drillers believe the borehole should be, drill another approximately 100 feet, and repeat the measurement process. In contrast to the existing systems, the telemetry system 1100 system includes sensors positioned on (and/or within) the drill bit, thereby enabling the system to continuously monitor the drilling and intervene if needed.

3. Geothermal Field Construction

In some embodiments disclosed herein, a geothermal field construction process can include three phases: a drilling phase, a geothermal loop insertion phase, and a grouting phase.

According to some embodiments of the present disclosure, the system 1000 (e.g., UCCTU 800) includes a coiled tubing that is used in at least two of the three phases (e.g., drilling and geothermal loop insertion; drilling and grouting; geothermal loop insertion and grouting; and/or drilling, geothermal loop insertion, and grouting) of the geothermal field construction.

In some embodiments, before the drilling phase, a rat hole of about 20-40 feet deep is drilled and a casing 1506 (e.g., a surface casing, a 6-7 inch diameter pipe) is installed in the rat hole. In some embodiments, coiled tubing is not used in the rat hole drilling process. The casing 1506 protrudes about 1-3 feet above the ground and is capped with a casing flange 1504, as illustrated in FIGS. 15A-1, 15A-2, and 15A-3. After the rat hole is drilled, the injector 820, the stripper 822, and flanges are installed on top of the casing 1506 to commence the CT-enabled geothermal field construction. In some embodiments, the distance between the injector 820 and the ground can be adjusted via the legs 840 to account for the casing 1506.

In some embodiments, the coiled tubing drilling technology disclosed herein can be combined with rotary drilling equipment. The CT and rotary drilling equipment (e.g., rotary drilling rig) can be mounted on the same chassis or on different chassis of vehicle(s) 810. For example, in some embodiments, the vehicle 810-1 or the vehicle 810-2 can be fitted with a mast that is connected to a pump and a generator (e.g., control cabin 812). The rotary drilling rig can drill the first 20- to 40 feet of borehole from the surface to facilitate installation of the casing 1506. Then, coiled tubing drilling is used to construct the geothermal field.

The drilling phase includes drilling (e.g., constructing) one or more boreholes of the geothermal field. According to some embodiments of the present disclosure, the drilling is performed using a drilling motor and a drill bit installed at one end of CT 818. The injector 820 pushes the CT 818 down into a borehole while water, drilling mud (e.g., drilling fluid) is pumped through CT 818 and the drilling motor (including a stator and rotor) rotates the drill bit. When the drill bit reaches the target depth, the CT 818 is pulled out of the hole. The drill bit and drilling motor are removed from the CT 818, and a washing nozzle 1222 is attached to the CT 818 for use in the geothermal loop insertion phase.

During the geothermal loop insertion phase, geothermal loops are inserted into the boreholes that were constructed in the drilling phase. In some embodiments disclosed herein, during the geothermal loop insertion phase, a geothermal loop 1220 (e.g., illustrated in FIGS. 12B and 13) is physically coupled to the CT 818 and is injected (e.g., simultaneously or concurrently) with the CT 818 using the CT injector 820.

Figures 2, 12A:
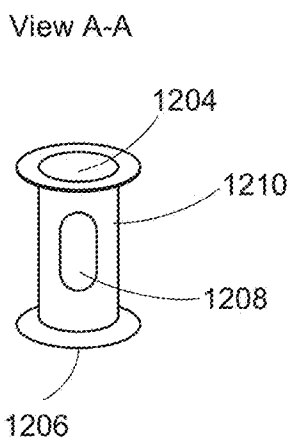
Figures 1, 12A:
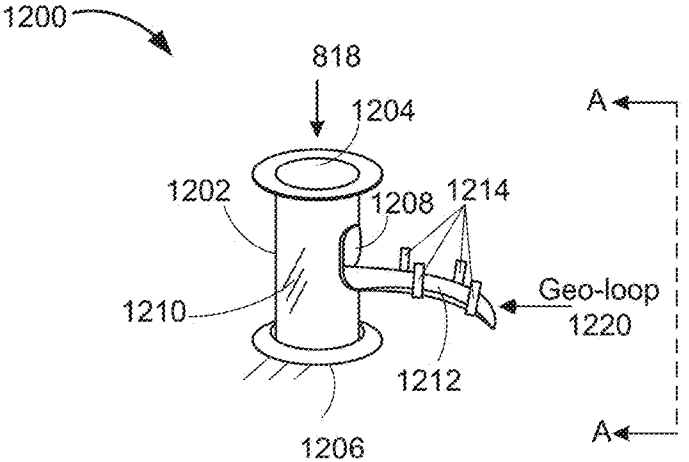
Figures 3, 15A:
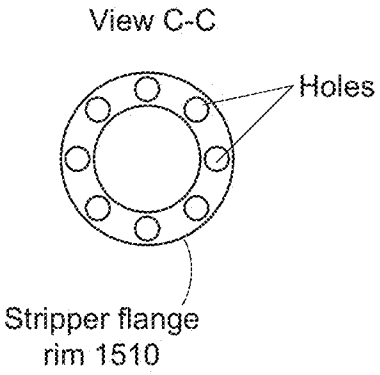
Figures 2, 15A:
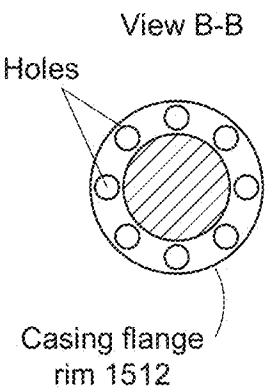
Figures 1, 15A:
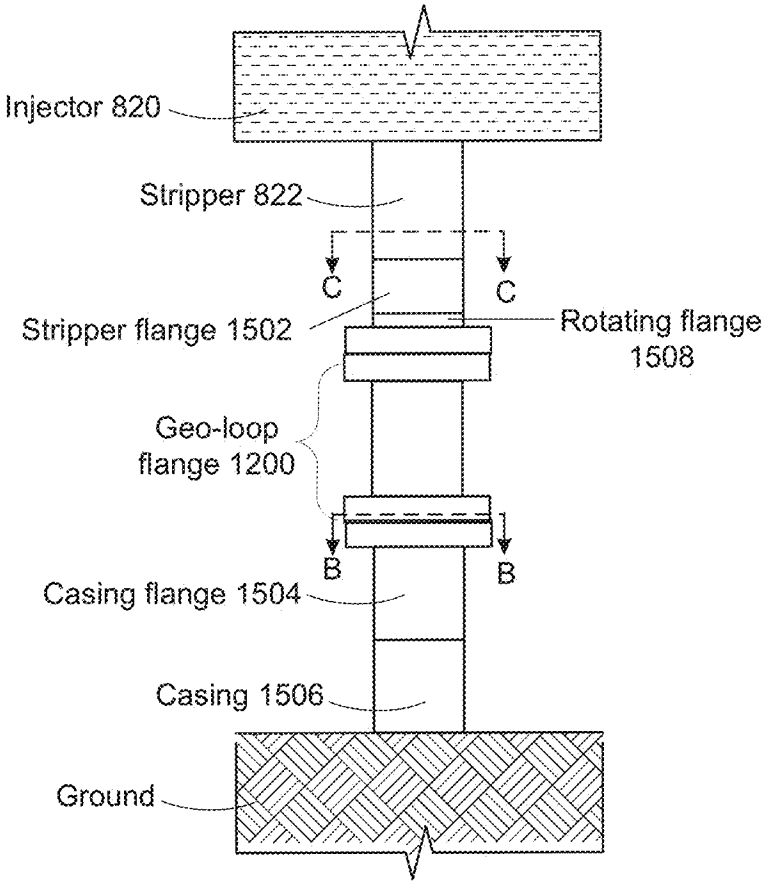
Figure 17B:
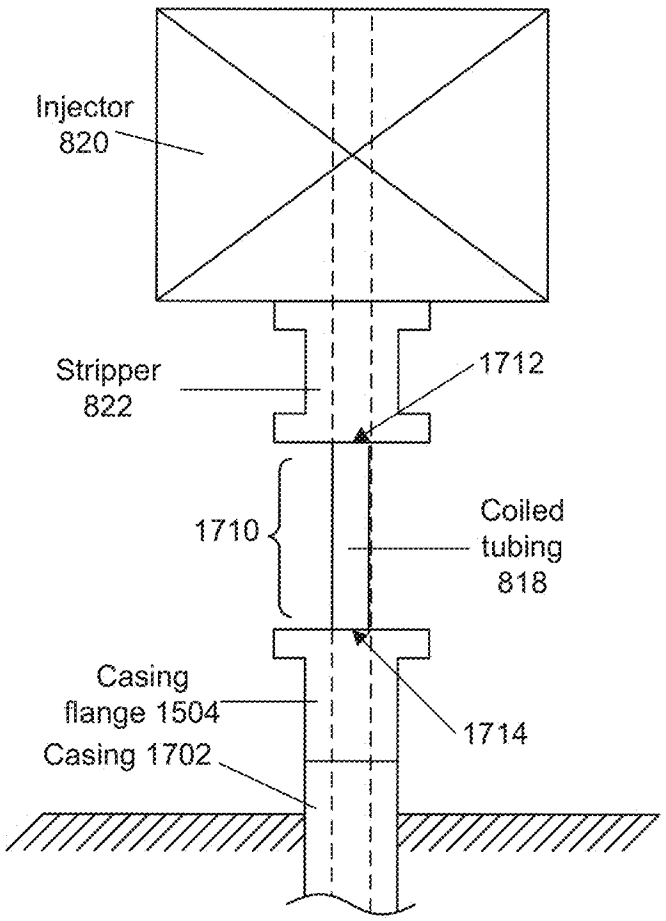
Figure 17B (PRIOR ART)
FIG. 17B illustrates a wellhead connection to an injector in existing systems.
Figure 17A:
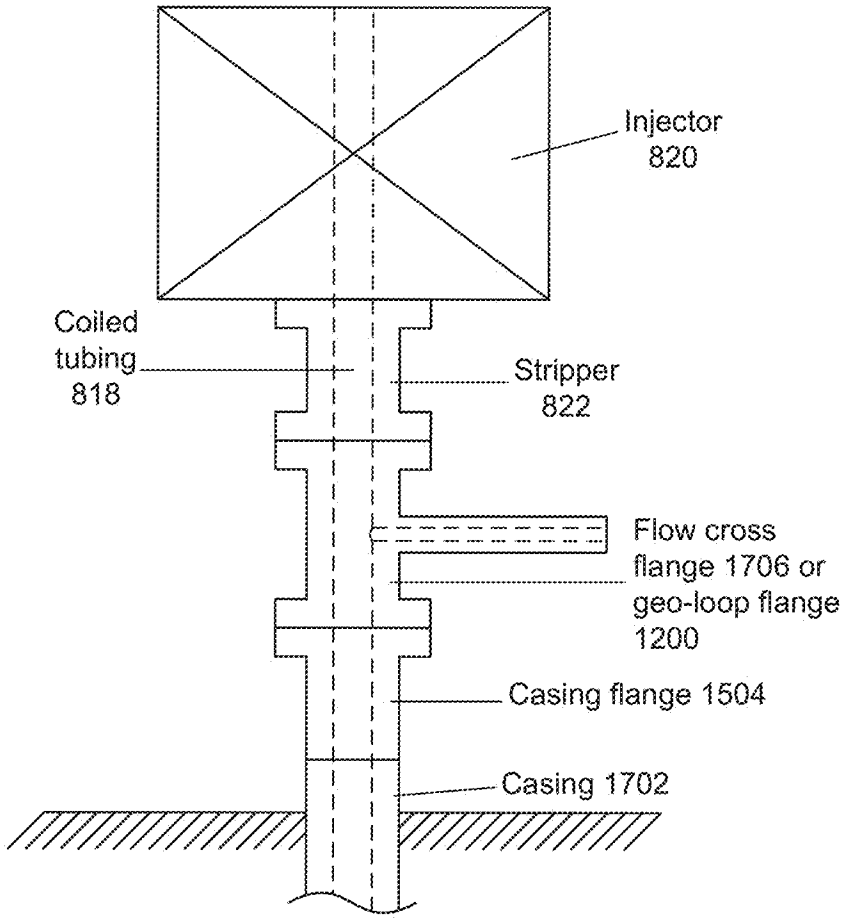
FIG. 17A illustrates a wellhead connection to an injector, in accordance with some embodiments of the present disclosure.

In accordance with some embodiments, a geo-loop flange 1200 facilitates insertion of a geothermal loop 1220 into a borehole during the geothermal loop insertion phase. FIGS. 12A-1 and 12A-2 illustrate two views of the geo-loop flange 1200, in accordance with some embodiments. FIG. 15A-1 and FIG. 17A show that in some embodiments, the geo-loop flange 1200 is mounted between the casing flange 1504 (below) and the stripper 822 (above). The stripper 822 is located below the injector 820, and a stripper flange 1502 is mounted below the stripper 822.

Referring to FIGS. 12A-1 and 12A-2, the geo-loop flange 1200 includes a coiled tubing guide member 1202 (e.g., a flange) for guiding the CT 818. The coiled tubing guide member 1202 includes a first end 1204 where the CT 818 enters. The coiled tubing guide member 1202 includes a second end 1206 where both the CT 818 and the geothermal loop 1220 exit. The coiled tubing guide member 1202 includes an opening 1208 on a side wall 1210 of the coiled tubing guide member 1202.

In some embodiments, the coiled tubing guide member 1202 is cylindrical (e.g., annular) (or largely cylindrical) in shape. In some embodiments, an outer diameter of the geo-loop flange 1200, as determined by the coiled tubing guide member 1202, is about 4-9 inches (e.g., ±1%, ±2%, ±5%, or ±10%), depending on the borehole size. In some embodiments, an inner diameter of the geo-loop flange 1200, as determined by the coiled tubing guide member 1202, is about 0.2-1 inch smaller than its outer diameter, depending on the material. In some embodiments, the geo-loop has a height that is about 1-3 feet (e.g., ±1%, ±2%, ±5%, or ±10%), depending on the borehole depth and an outer diameter of the geothermal loop.

The geo-loop flange 1200 includes a geothermal loop guide member 1212 for guiding the geothermal loop 1220 into the opening 1208 and out through the second end 1206 of the coiled tubing guide member 1202.

In some embodiments, the geothermal loop guide member 1212 is arch-shaped (e.g., shaped like a gooseneck). The geothermal loop guide member 1212 can have a length that is about 1 to 3 feet long, with a radius of curvature between 6 inches and 18 inches, depending on a bending radius of the geothermal loop.

In some embodiments, the geothermal loop guide member 1212 has a rounded (e.g., beveled or chamfered) edge.

In some embodiments, the geothermal loop guide member 1212 includes rollers 1214 for guiding the geothermal loop 1220 into opening 1208.

The coiled tubing guide member 1202 is physically and permanently coupled to a geothermal loop guide member 1212. For example, in some embodiments, the coiled tubing guide member 1202 and the geothermal loop guide member 1212 are welded to each other.

The geo-loop flange 1200 can be made using a material such as carbon steel, fiberglass, high-density polyethylene (HDPE) or polyethylene high-density (PEHD). The geo-loop flange 1200 is installed after drilling phase commences and the drill bit is replaced by the washing nozzle tool. The geo-loop flange 1200 stays mounted between the casing flange 1504 and the stripper 822 during the geothermal loop insertion process, while the CT 818 travels to the bottom, and during the grouting phase, while the CT 818 travels back to the surface.

Figure 12B:
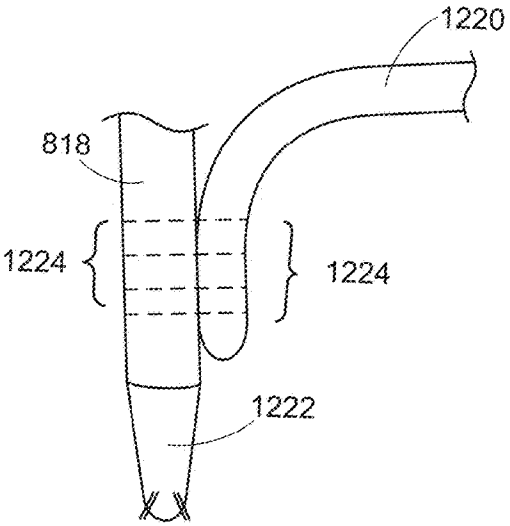
FIG. 12B illustrates physically coupling a coiled tubing and a geothermal loop, in accordance with some embodiments.

An exemplary usage scenario of the geo-loop flange 1200 during the geothermal loop insertion phase includes the steps of:

1. Inserting the CT 818 through the geo-loop flange 1200;
2. Mounting the geo-loop flange 1200 below the stripper 822;
3. Inserting the geothermal loop 1220 through the geo-loop flange 1200;
4. Attaching the geothermal loop 1220 to the CT 818 when they have both exited from the second end 1206. For example, FIG. 12B shows that the CT 818 and the geothermal loop 1220 can be physically coupled to each other using adhesive tape 1224, a band, a bracket, a hook, or any other coupling mechanism. Regardless of the coupling mechanism, the geothermal loop 1220 should be positioned (and kept) above the CT 818 because the driving force of the CT 818 is necessary to push the geothermal loop 1220 into the borehole;
5. After coupling the geothermal loop 1220 and the CT 818, the geo-loop flange 1200 is mounted on top of the casing flange 1504 (with the CT 818 and geothermal loop 1220 inside the geo-loop flange 1200 and the casing flange 1504).

Figure 13:
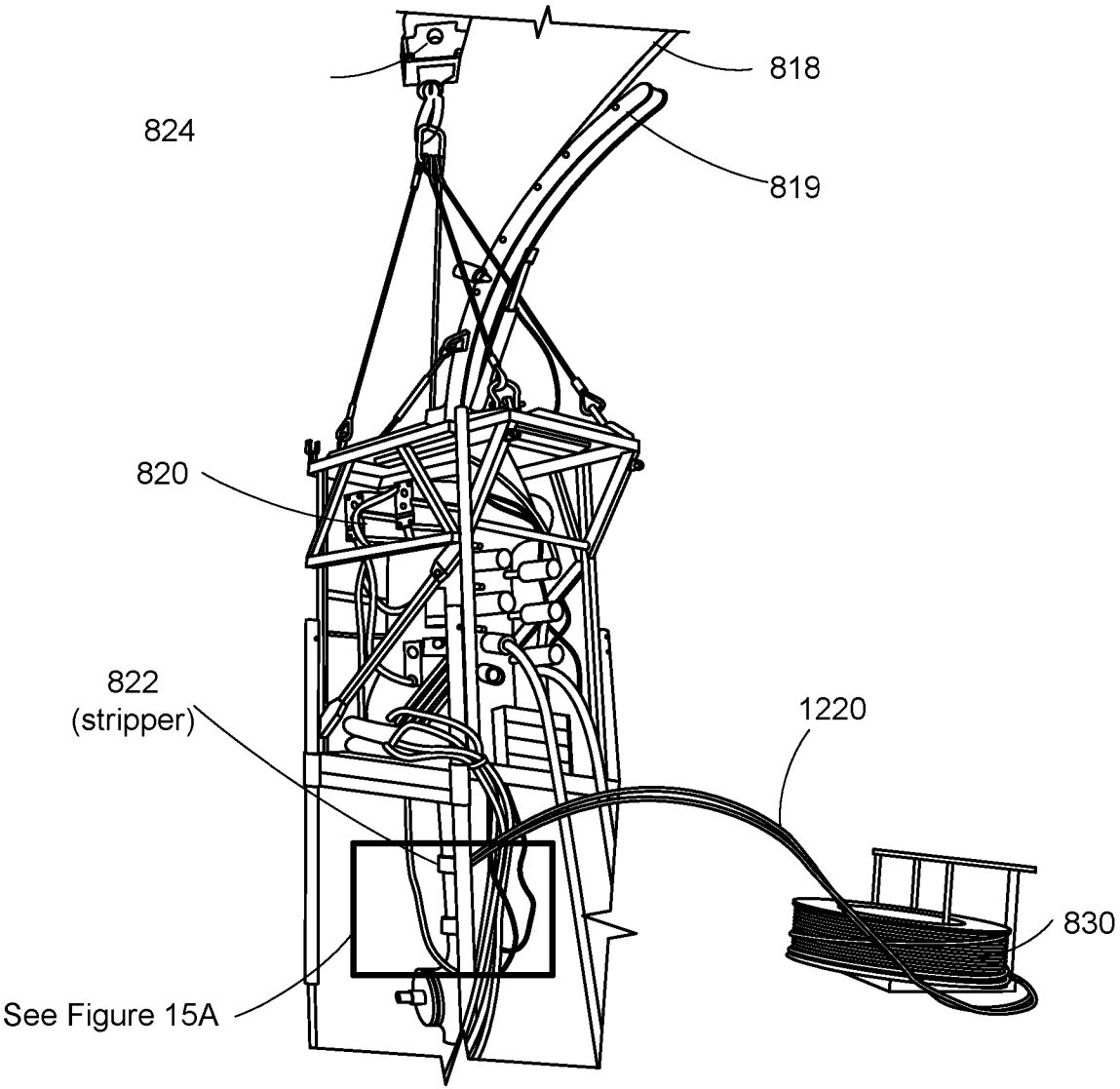
FIG. 13 illustrates geothermal loop insertion via a geo-loop flange and a coiled tubing, in accordance with some embodiments.

FIG. 13 illustrates geothermal loop insertion via the geo-loop flange 1200 and CT 818, in accordance with some embodiments.

Figure 14:
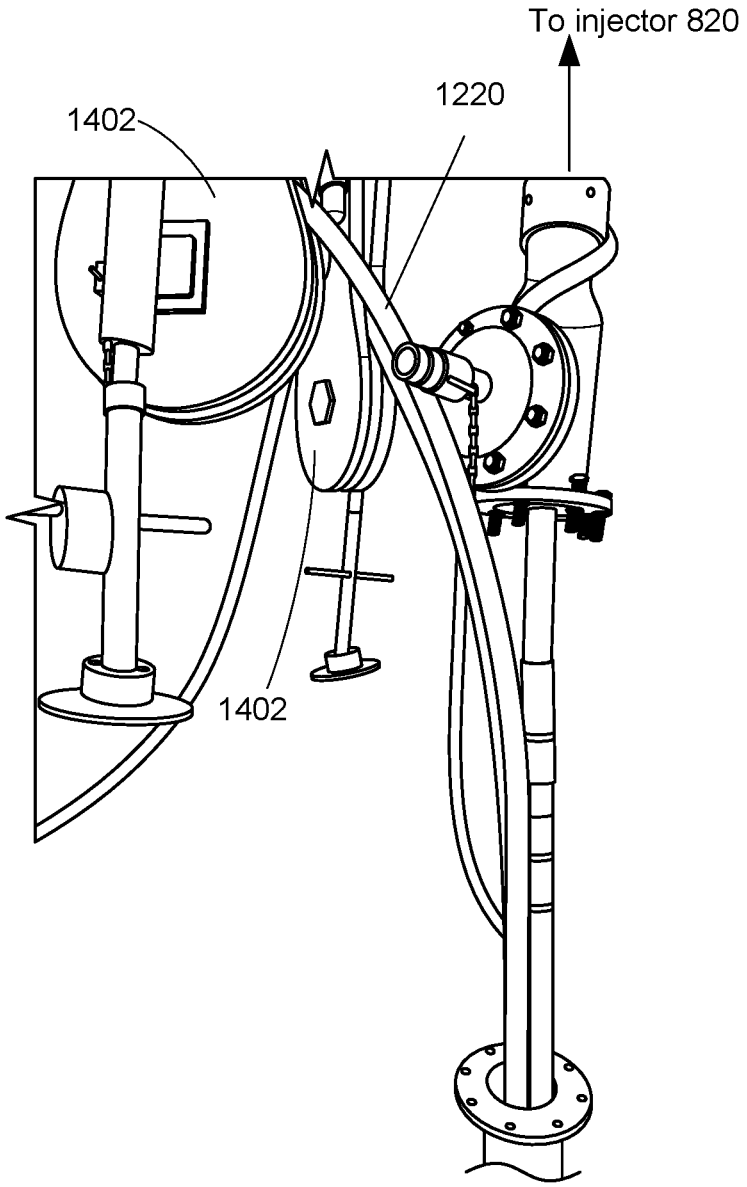
FIG. 14 illustrates rollers for stabilizing a geothermal loop 1220, in accordance with some embodiments.

In some embodiments, rollers can be used to guide the geothermal loop 1220 during the insertion process. FIG. 14 illustrates rollers 1402, positioned below the injector head 820, for stabilizing the geothermal loop 1220 and guiding the geothermal loop 1220 into the borehole, in accordance with some embodiments.

In some embodiments, the rollers 1402 are used in conjunction with the geo-loop flange 1200.

In some embodiments, the rollers 1402 are used without the geo-loop flange 1200.

The geothermal loop 1220 is driven by the CT 818 into its desired depth. During this process, the washing nozzle 1222 that is mounted on the CT 818 is used for pumping high-pressure water to clear any obstacle/debris that is encountered in front of the geothermal loop 1220, while pushing down the geothermal loop 1220. When the geothermal loop 1220 has reached its target depth, it is detached from the CT 818.

FIG. 15A illustrates a stripper flange in accordance with some embodiments. The stripper flange 1502 is coupled to the stripper 822 (e.g., via welding, screws, or bolts and nuts). The coupling between the stripper flange 1502 and the stripper 802 can be permanent or temporary. A casing flange 1504 is coupled to a casing 1506 (e.g., via welding, screws, or bolts and nuts). The holes of the stripper flange 1502 and the holes of the casing flange 1504 are aligned with one another, and screws (e.g., fasteners or bolts) are passed through respective sets of stripper flange hole and casing flange hole to secure the two flanges. The casing flange 1504 is not movable when the casing 1506 is fixed into borehole. When the injector 820 is moved with the crane 824 above the casing flange 1504, significant lateral torque is applied to the injector 820 to align the holes of the two flanges. In some embodiments, the stripper flange 1502 has a rotating joint (e.g., illustrated at rotating flange 1508 in FIG. 15A), so only the stripper flange rim 1510 need to be rotated to align the holes of the two flanges.

In some embodiments, the stripper flange 1502 and the casing flange 1504 are secured using clamps. One advantage of using clamps is that only the flanges—and not the holes—need to be aligned with each other. Deep oil and gas drilling use flanges that are secured to each other with thick bolts and nuts to ensure that the flanges do not explode in case of a pressure kick (e.g., ~5,000 to 10,000 psi). Because high pressures like these are typically not encountered in shallow- and mid-range-length well drilling, the flanges can be secured to each other using clamps without compromising safety.

In some embodiments, a cross-over flange 1520 (for diverting the return drilling mud) and/or a geo-loop flange can be installed between the stripper flange 1502 and the casing flange 1504. This is illustrated in FIG. 15B.

Figure 15B:
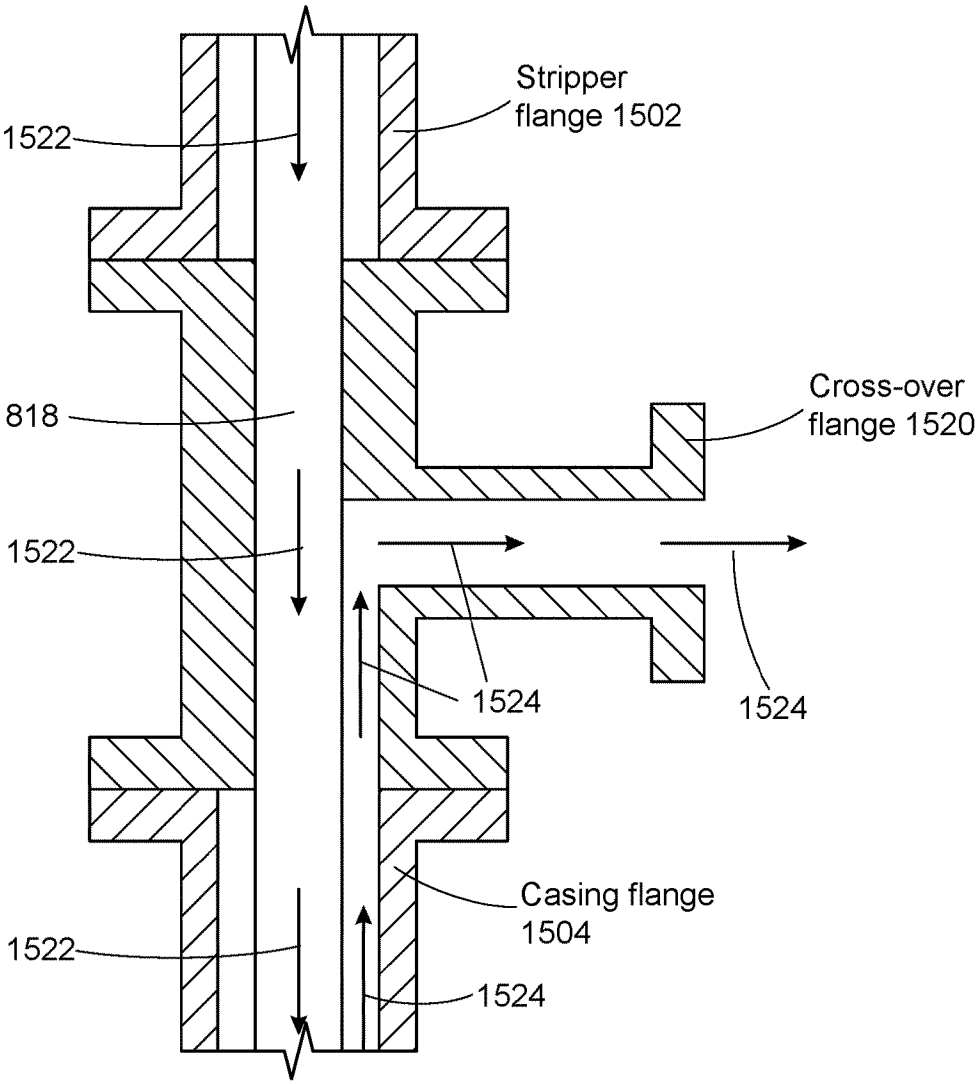
FIG. 15B illustrates a cross-over flange, in accordance with some embodiments.

FIG. 15B shows that when drilling mud (indicated by arrows 1522) is being pumped down through CT 818, the drilling mud picks up cuttings (e.g., small pieces of rock just drilled) and is diverted through the cross-over flange (indicated by arrows 1524) through shakers and filers. The cuttings are separated, and the cleaned drilling mud is pumped down again through the CT 818 (indicated by arrows 1522).

The third phase of the geothermal field construction is grouting. Grouting is the process of injecting grout into spaces (e.g., gaps) between a borehole and a geothermal loop, to seal off fluid flow and reinforce well integrity. Grouting can also help maintain the desired temperature gradients necessary for efficient geothermal extraction.

In accordance with some embodiments of the present disclosure, after the geothermal loop 1220 detaches at the bottom and the CT 818 is pulled back to the surface, the washing nozzle 1222 is used to squeeze grout to fill spaces between the borehole and the geothermal loop 1220.

The casing 1506 stays in the rat hole during the CT-enabled drilling and geothermal loop installation and grouting phases. Before the grout completely sets (i.e., when the grout is still soft), the casing 1506 is pulled out of the rat hole using a crane or forklift.

In some embodiments, drill cuttings (e.g., broken bits of rocks and other solid materials) removed from the borehole(s) during the drilling phase can be reduced to smaller pieces (e.g., by grinding the cuttings) to form gravel pack (e.g., a volume of ground cuttings), which are injected back to the subsurface during the grouting phase. Using drill cuttings in addition to or in place of grout has several benefits including reduced costs and improved logistics. Drill cuttings are generated during every drilling process and are available for use at no cost whereas grout needs to be sourced, paid for, and transported to the construction site. Furthermore, drill cuttings need to be disposed of after drilling, so re-introducing them back to the subsurface further reduces the time and costs associated with disposal.

Figure 18A:
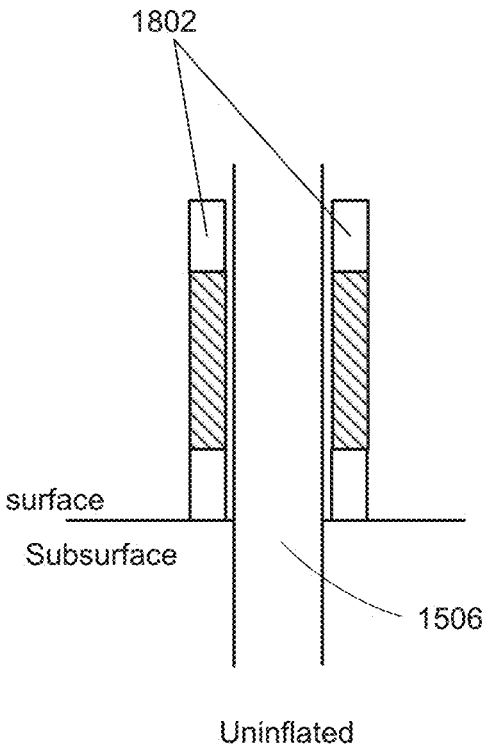
FIGS. 18A and 18B illustrate cross sectional views of an inflatable packer in uninflated and inflated states, respectively, in accordance with some embodiments.
Figure 18B:
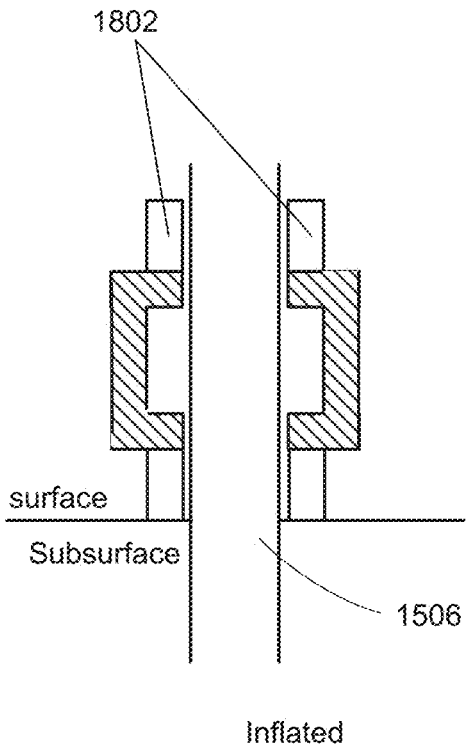

FIGS. 18A and 18B illustrate respective cross sectional views of an inflatable packer 1802 in an uninflated state and in an inflated state, respectively, in accordance with some embodiments.

In some embodiments, inflatable packers are used to seal the surface casing (e.g., casing 1506) during drilling, geo-loop installation, and grouting.

In its simplest form, the packer 1802 is a cylindrical, elastic membrane that is sealed at the ends and that, when internally pressurized, inflates radially. The radial inflation is used to seal and anchor the packer 1802 in place in the hole or pipe in which it is inserted. In practice, the packer 1802 looks like a short length of hose with steel end fittings and, usually, a central through pipe. The packer 1802 includes an inflation medium that is introduced between the central pipe and the inside of the membrane. The membrane can be a simple rubber tube, or a fabric and wire-reinforced rubber element, or a thin metal sheath. The membrane material has a large bearing on the pressure rating for the complete packer and on the applications for which it is suitable. A simpler packer with an unreinforced rubber membrane will have a very low pressure rating, e.g., around 10-400 psi. The pressure rating of a packer with metal reinforcement can vary between around 500 to 5,000 psi.

As disclosed herein, one or more inflatable packers 1802 can be installed at the surface to seal the casing 1506, instead of using grout. The advantage is that after completing the borehole grouting operation (e.g., filling the interior of the borehole with grout), the packer would be deflated and reused in another borehole. By contrast, if the casing 1506 is grouted on the outside, the casing and solidified grout will form a solid structure and a crane will be needed remove the casing after the borehole installation.

The present disclosure differentiates from current geothermal well construction processes, which employ different pieces of equipment for each phase. At the present, the industry uses a drilling rig for drilling, some kind of manually operated reel to insert the geothermal loop into boreholes, and a tremie line to grout. To the best of the Applicant's knowledge, coiled tubing is not currently used for shallow geothermal drilling, nor has there been any attempt to utilize coiled tubing for geothermal loop insertion or grouting.

The present disclosure of employing coiled tubing for multiple phases (e.g., drilling, geothermal loop insertion, and/or grouting phases) of the geothermal field construction fills the technology void for mid-range-length wells that are between ~500 feet and ~3,000 feet deep.

The present disclosure also advantageously improves upon current geothermal well construction processes in several ways. First, the current practice of manually inserting geothermal loops into boreholes is difficult, physically demanding, and time-consuming when the well depths are ~800 feet and upwards, depending on the groundwater depth. The challenge is exacerbated when groundwater is present, or when boreholes are not straight. The risk of geothermal loops getting stuck in the lateral borehole walls or pushed back by buoyancy is quite high, and limits the ability to install them to greater depths. Using coiled tubing for geothermal loop insertion makes the process faster and more efficient. Coiled tubing, being carbon steel pipe, can push geothermal loops to depths unheard of by the current shallow geothermal drilling industry. Second, for the grouting process, the current industry uses Tremie lines which are hoses that are about an inch in diameter. Because grout is a viscous paste, pumping grout through one-inch-diameter tremie lines at depths greater than ~500 to 600 feet is operationally impossible. Larger-size tremie lines are not used because driller would encounter challenges to run them manually.

The advantages of using the UCCTU 800 for at least two of the three phases, or all three phases of the geothermal well construction, include: greater depths (e.g., 500 feet to 2,500 feet) can be achieved; less equipment is used; greater control, and faster operations. The improvements disclosed herein are novel and non-obvious not only because coiled tubing technology is not currently used for shallow geothermal drilling, but also because additional equipment (e.g., a geo-loop flange 1200) and procedures need to be developed in order to attach the geothermal loop to the coiled tubing at the surface, push it through the geo-loop flange 1200, detach the geothermal loop once it is at the bottom, and use washing nozzles 1222 coupled to coiled tubing for cleaning the borehole and for grouting.

Figure 16:
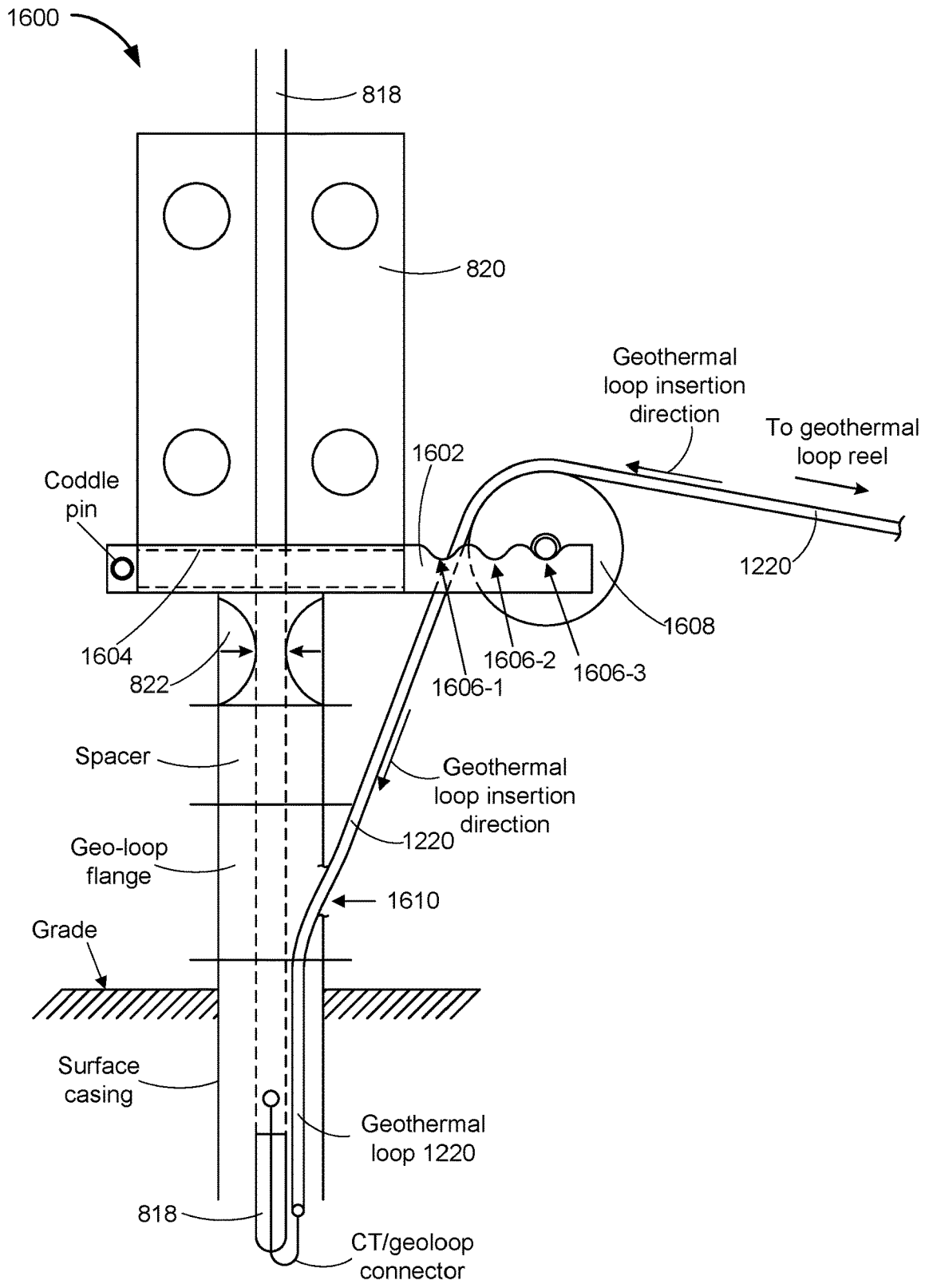
FIG. 16 illustrates a geothermal loop insertion method, in accordance with some embodiments.

FIG. 16 illustrates a geothermal loop insertion process 1600, in accordance with some embodiments. In some embodiments, the process 1600 uses a removable arm 1602 that is configured to be inserted into a forklift pocket 1604 of the injector 820. The arm 1602 includes designated axle points (e.g., defined by positions 1606 on the arm 1602) that each corresponds to a respective geothermal loop minimum bend radius. The geothermal loop minimum bend radius can depend on the size (e.g., diameter) of the geothermal loop 1220. For example, in FIG. 16, the position 1606-1 can correspond to a minimum bend radius of 1 inch, the position 1606-2 can correspond to a minimum bend radius of 1.5 inches, and the position 1606-3 can correspond to a minimum bend radius of 2 inches. Interchangeable spools 1608 for minimum radius can be positioned on the arm 1602. A spool can have a diameter that is about 10-30 times the diameter of the geothermal loop 1220. The geothermal loop 1220 passes through a window/opening 1610 and is physically coupled to the CT 818 (e.g., using the coupling methods discussed in FIG. 12B).

FIG. 17A illustrates a wellhead connection to an injector, in accordance with some embodiments of the present disclosure. FIG. 17B illustrates a wellhead connection to an injector in existing systems.

In FIG. 17A, the casing flange 1704 is connected to the stripper 822 via a flow cross flange 1706 (for drilling fluid mud returns) or a geo-loop flange 1708. By contrast, FIG. 17B shows that there is a region 1710 (e.g., gap) between the stripper 822 and the casing flange 1504, where the CT 818 is exposed. The CT 818 in FIG. 17B can rub against edges 1712 of the stripper 822 or edges 1714 of the casing flange 1504 when is moving, leading to wear and tear and eventual failure of the CT 818. Thus, compared to existing systems, the improved wellhead design that is shown in FIG. 17A reduces fatigue on the CT 818 and increases its useful lifetime.

Figure 19:
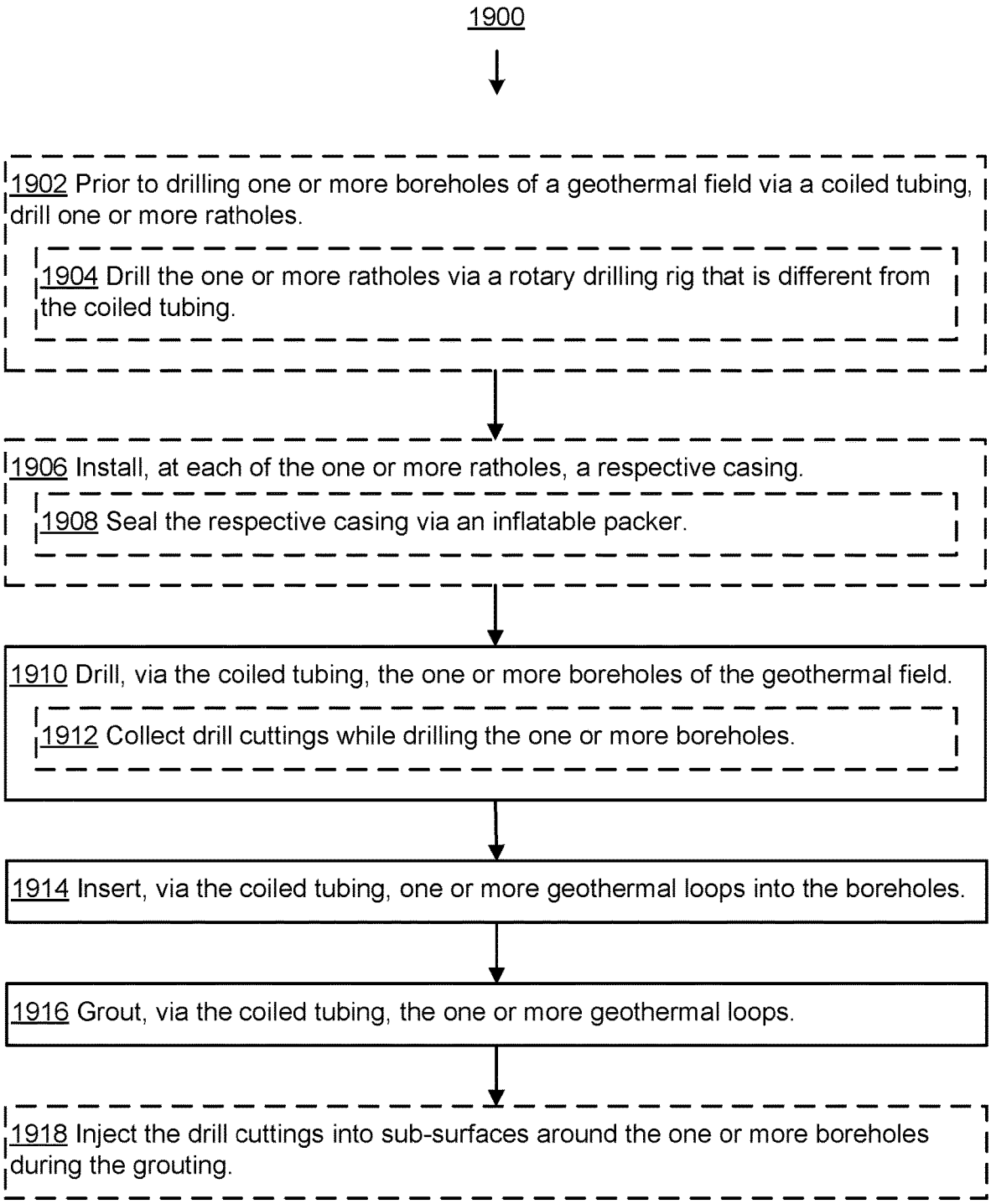
FIG. 19 provides a flowchart of a method for constructing geothermal fields, in accordance with some embodiments.

FIG. 19 provides a flowchart illustrating an exemplary method 1900 for constructing geothermal fields, in accordance with some embodiments.

In some embodiments, the method 1900 includes, prior to drilling one or more boreholes of a geothermal field via a coiled tubing (e.g., CT 818), drilling (1902) one or more ratholes. In some embodiments, the one or more ratholes are drilled (1904) via a rotary drilling rig that is different from the coiled tubing. In some embodiments, the method includes installing (1906), at each of the one or more ratholes, a respective casing. In some embodiments, the method includes sealing (1908) the respective casing via an inflatable packer (e.g., packer 1802).

In some embodiments, the method 1900 includes drilling (1910), via the coiled tubing, the one or more boreholes of the geothermal field. In some embodiments, the method includes collecting (1912) drill cuttings while drilling the one or more boreholes. The method includes inserting (1914), via the coiled tubing, one or more geothermal loops into the boreholes. In some embodiments, the method includes grouting (1916), via the coiled tubing, the one or more geothermal loops. In some embodiments, the method includes injecting (1918) the drill cuttings into sub-surfaces around the one or more boreholes during the grouting.

Turning now to some example embodiments:

(A1) In accordance with some embodiments of the present disclosure, a system (e.g., system 1000) for constructing geothermal fields comprises coiled tubing (e.g., a coiled tubing, such as CT 818, or a CT string, or a continuous length of metal or composite tubing with no joints) that is configured for (e.g., performs operations comprising) (i)

drilling (e.g., constructing) a borehole (e.g., one or more boreholes) of a geothermal field; (ii) inserting a geothermal loop into the borehole; and (iii) grouting the geothermal loop (e.g., using a Bentonite-based thermal grout and/or a sand mixture). For example, in some embodiments, a geothermal field construction process uses the same coiled tubing for multiple operations including borehole drilling, geothermal loop insertion, and/or grouting.

(A2) In some embodiments of A1, the system includes a downhole telemetry assembly (e.g., downhole telemetry assembly 1100) (e.g., wired or wireless) coupled to the coiled tubing and having a plurality of sensors (e.g., sensors 502 or sensors 1050). The system includes one or more processors 1002, and memory 1006 storing instructions that are configured for execution by the processors 1002. The memory stores instructions that, when executed by the one or more processors, cause the system to: (i) obtain (e.g., sense, measure, determine, collect), in real-time via the plurality of sensors, downhole telemetry data (subsurface data) during the drilling, the inserting, and the grouting.

(A3) In some embodiments of A2, the memory includes instructions that, when executed by the one or more processors, cause the system to: while drilling the one or more boreholes, minimize a lateral drift (e.g., a horizontal distance between an actual borehole and a planned trajectory) in accordance with the measured downhole telemetry data (that is measured by one or more downhole inclination and/or azimuth sensors).

(A4) In some embodiments of A2 or A3, the memory includes instructions that, when executed by the one or more processors, cause the system to determine, via the plurality of sensors, a borehole depth for a first borehole. The memory includes instructions that, when executed by the one or more processors, cause the system to, while inserting the one or more geothermal loops: (i) determine, via the real time telemetry data (via the sensors), an insertion depth for a first geothermal loop that is inserted into the first borehole; and (ii) in accordance with a determination that the insertion depth is within a predetermined margin of the borehole depth, cease the inserting process.

As an example, in some embodiments, the downhole telemetry data includes a borehole depth (X) that is obtained during drilling. During the loop insertion step, the geothermal loop is inserted to the borehole. The sensors measure a depth (Y) that is attained as the geothermal loop is inserted. In accordance with a determination that the depth X is within a predetermined margin of Y (e.g., when the values are within ±0.1%, ±0.3%, ±0.5%, ±1%, ±2% or ±5% of each other), the system (via the processors) determine that the desired depth has been reached.

(A5) In some embodiments of any of A2-A4, the memory includes instructions that, when executed by the one or more processors, cause the system to grout the one or more geothermal loops in accordance with the measured downhole telemetry data. For example, the grout flow rate and CT speed need to be correlated so that grout is fully filling the borehole. In some embodiments, the system (via the processors 1002) monitor depth, downhole pressure (e.g., internal and external pressure), temperature (e.g., internal and external temperature), grout thermal conductivity (downhole), grout flow rate (from surface), and grout volume (from surface) to determine whether the borehole is fully filled with grout.

(A6) In some embodiments of any of A2-A5, the plurality of sensors includes two sensors selected from the group consisting of: a pressure sensor, a temperature sensor, a gamma ray sensor, an inclination and/or azimuth sensor, a vibration sensor, an acceleration sensor, a force sensor, a torque sensor, a pH sensor, a salinity sensor, and/or a thermal conductivity sensor.

(A7) In some embodiments of any of A2-A6, the plurality of sensors includes a first subset of (e.g., one or more) sensors that are positioned on an exterior surface of the downhole telemetry assembly; and a second subset of (e.g., one or more) sensors that are positioned on an interior surface of the downhole telemetry assembly. The exterior surface of the downhole telemetry assembly, or an outward-facing surface, is a surface that is directly exposed to a subsurface of the ground during drilling. The interior surface of the downhole telemetry assembly, or an inward-facing surface, is a surface that is not directly exposed to a subsurface of the ground during drilling.

(A8) In some embodiments of any of A1-A7, the system includes a coiled tubing injector (e.g., injector 820) for injecting the coiled tubing from a surface into a subsurface during the drilling, the inserting, and the grouting.

(A9) In some embodiments of A8, the system includes one or more roller mechanisms (e.g., rollers 1402) coupled to (e.g., mounted to) the injector, for guiding the one or more geothermal loops as they are inserted into the one or more boreholes.

(A10) In some embodiments of A9, the one or more roller mechanisms include a depth gauge (e.g., level-wing depth counter) for measuring a length of a first geothermal loop installed in a first borehole.

(A11) In some embodiments of any of A8-A10, the system includes a gooseneck (e.g., gooseneck 819) for guiding the coiled tubing into a body of the coiled tubing injector, wherein the gooseneck is configured to rotate to align the coiled tubing and the coiled tubing injector as the coiled tubing is unspooled (e.g., laterally). In some embodiments, the gooseneck is fitted with a telescopic arm with a ball to ensure that the gooseneck is only moving laterally.

(A12) In some embodiments of any of A8-A11, the coiled tubing injector is mounted on a stand (e.g., stand 838) during the drilling, the inserting, and the grouting.

(A13) In some embodiments of A12, the system is configured to, while drilling a borehole, in accordance with a determination that the borehole is tilted with respect to a vertical axis, adjust a respective height of one or more legs (e.g., legs 840) of the stand (e.g., to change a drilling angle).

(A14) In some embodiments of any of A8-A13, the system includes a rotating flange (e.g., rotating flange 150) for aligning the coiled tubing injector on the casing flange (e.g., casing flange 1504).

(A15) In some embodiments of any of A1-A14, a respective borehole has a depth in a range of about 500 feet to 3000 feet (e.g., within a threshold of ±2%, ±5%, or ±10%).

(A16) In some embodiments of any of A1-A14, a respective borehole has a depth in a range of about 500 feet to 2500 feet (e.g., within a threshold of ±2%, ±5%, or ±10%).

(A17) In some embodiments of any of A1-A16, the coiled tubing is configured for performing the drilling, the inserting, and the grouting operations when the coiled tubing is unspooled from a reel (e.g., CT reel 816).

(B1) In accordance with some embodiments, an apparatus (e.g., geo-loop flange 1200) for facilitating insertion of a geothermal loop into a borehole includes a coiled tubing guide member (1202) (e.g., a flange) having (i) a first end (1204), (ii) a second end (1206), and (iii) an opening (1208) on a side wall (1210) of the coiled tubing guide member. The coiled tubing guide member 1202 is configured for guiding a coiled tubing through the first end and the second end. The apparatus includes a geothermal loop guide member (1212)

physically coupled to (e.g., attached to, connected to, by welding) the coiled tubing guide member at the opening. The geothermal loop guide member is configured for guiding the geothermal loop through the opening and through the second end.

(B2) In some embodiments of B1, the geothermal loop guide member is arch-shaped (e.g., has a gooseneck shaped).

(B3) In some embodiments of B1 or B2, the geothermal loop guide member comprises rollers (1214) for guiding the geothermal loop into the opening.

(B4) In some embodiments of any of B1-B3, the geothermal loop guide member comprises a rounded (e.g., beveled or chamfered) edge.

(B5) In some embodiments of any of B1-B4, the coiled tubing (e.g., CT 818) is part of a coiled tubing rig that includes a stripper (822) positioned below an injector (820) of the rig, and the apparatus is positioned below the stripper.

(B6) In some embodiments of B5, the apparatus is positioned between the stripper (822) and a casing flange (1504).

(B7) In some embodiments of any of B1-B6, the coiled tubing (e.g., CT 818) and the geothermal loop (1220) are physically coupled (abutted) together (e.g., via an adhesive tape, a bracket, a hook, or any other coupling mechanisms) after passing through the second end.

(B8) In some embodiments of any of B1-B7, an outer diameter of the coiled tubing guide member is in the range of about 4 inches to 9 inches.

(B9) In some embodiments of any of B1-B8, an inner diameter of the coiled tubing guide member is in the range of about 2 inches to 8.5 inches.

(B10) In some embodiments of any of B1-B9, the coiled tubing guide member comprises a cylindrical flange.

(C1) In accordance with some embodiments, a method for constructing geothermal fields includes (i) drilling, via a coiled tubing (e.g., CT 818), one or more boreholes (e.g., boreholes 402) of a geothermal field; (ii) inserting, via the coiled tubing, one or more geothermal loops (e.g., geothermal loop 1220) into the constructed boreholes; (iii) and grouting, via the coiled tubing, the one or more geothermal loops.

(C2) In some embodiments of C1, the method further includes: prior to drilling the one or more boreholes, (i) drilling one or more ratholes (e.g., a borehole that is around 10-50 feet deep) via a rotary drilling rig that is different from the coiled tubing; and (ii) installing a respective casing at each of the one or more ratholes.

(C3) In some embodiments of C2, the method further includes sealing the respective casing via an inflatable packer (e.g., inflatable packer 1802).

(C4) In some embodiments of any of $C_1$-$C_3$, the method further includes (i) collecting drill cuttings during the drilling; and (ii) during the grouting, injecting the drill cuttings into sub-surfaces around the one or more boreholes.

(C5) In some embodiments of any of $C_1$-$C_4$, the drilling, the inserting, and the grouting are performed when the coiled tubing is unspooled from a reel (e.g., CT reel 816).

(C6) In some embodiments of C5, the unspooling is facilitated (e.g., utilizes) an injector (e.g., CT injector 820).

The terminology used in the description of the invention herein is for the purpose of describing particular implementations only and is not intended to be limiting of the invention. As used in the description of the invention and the appended claims, the singular forms "a," "an," and "the" are intended to include the plural forms as well, unless the context clearly indicates otherwise. It will also be understood that the term "and/or" as used herein refers to and encompasses any and all possible combinations of one or more of the associated listed items. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

As used herein, the phrase "based on" does not mean "based only on," unless expressly specified otherwise. In other words, the phrase "based on" describes both "based only on" and "based at least on."

As used herein, the term "exemplary" means "serving as an example, instance, or illustration," and does not necessarily indicate any preference or superiority of the example over any other configurations or implementations.

As used herein, the term "and/or" encompasses any combination of listed elements. For example, "A, B, and/or C" includes the following sets of elements: A only, B only, C only, A and B without C, A and C without B, B and C without A, and a combination of all three elements, A, B, and C.

The foregoing description, for purpose of explanation, has been described with reference to specific implementations. However, the illustrative discussions above are not intended to be exhaustive or to limit the invention to the precise forms disclosed. Many modifications and variations are possible in view of the above teachings. The implementations were chosen and described in order to best explain the principles of the invention and its practical applications, to thereby enable others skilled in the art to best utilize the invention and various implementations with various modifications as are suited to the particular use contemplated.

What is claimed is:

1. A system for constructing geothermal fields, comprising:

coiled tubing configured for:

drilling a borehole of a geothermal field;

inserting a geothermal loop into the borehole; and grouting the geothermal loop.

2. The system of claim 1, further comprising:

a downhole telemetry assembly coupled to the coiled tubing and having a plurality of sensors;

one or more processors; and memory storing instructions that, when executed by the one or more processors, cause the system to:

obtain, in real-time via the plurality of sensors, downhole telemetry data during the drilling, the inserting, and the grouting.

3. The system of claim 2, wherein the memory includes instructions that, when executed by the one or more processors, cause the system to:

while drilling the borehole, minimize a lateral drift in accordance with the downhole telemetry data.

4. The system of claim 2, wherein the memory includes instructions that, when executed by the one or more processors, cause the system to:

determine, via the plurality of sensors, a borehole depth for the borehole;

while inserting the geothermal loop:

determine, in real time via the downhole telemetry data, an insertion depth for the geothermal loop that is inserted into the borehole; and in accordance with a determination that the insertion depth is within a predetermined margin of the borehole depth, cease to insert the geothermal loop.

5. The system of claim 2, wherein the memory includes instructions that, when executed by the one or more processors, cause the system to:

grout the geothermal loop in accordance with the downhole telemetry data.

6. The system of claim 2, wherein the plurality of sensors includes at least two sensors selected from the group consisting of: a pressure sensor, a temperature sensor, a gamma ray sensor, an inclination and/or azimuth sensor, a vibration sensor, an acceleration sensor, a force sensor, a torque sensor, a pH sensor, a salinity sensor, and/or a thermal conductivity sensor.

7. The system of claim 2, wherein the plurality of sensors includes:

a first subset of sensors that are positioned on an exterior surface of the downhole telemetry assembly; and a second subset of sensors that are positioned on an interior surface of the downhole telemetry assembly.

8. The system of claim 1, further comprising:

a coiled tubing injector for injecting the coiled tubing from a surface into a subsurface during the drilling, the inserting, and the grouting.

9. The system of claim 8, further comprising:

one or more roller mechanisms coupled to the coiled tubing injector, for guiding the geothermal loop as it is inserted into the borehole.

10. The system of claim 9, wherein the one or more roller mechanisms include a depth gauge for measuring a length of a first geothermal loop installed in a first borehole.

11. The system of claim 8, further comprising:

a gooseneck for guiding the coiled tubing into a body of the coiled tubing injector, wherein the gooseneck is configured to rotate to align the coiled tubing and the coiled tubing injector as the coiled tubing is unspooled.

12. The system of claim 8, wherein the coiled tubing injector is mounted on a stand during the drilling, the inserting, and the grouting.

13. The system of claim 12, wherein the system is configured to:

while drilling the borehole, in accordance with a determination that the borehole is tilted with respect to a vertical axis, adjust a respective height of one or more legs of the stand.

14. The system of claim 8, wherein a rotating flange is used for aligning the coiled tubing injector on a casing flange.

15. The system of claim 1, wherein a respective borehole has a depth from 500-3000 feet within a first threshold.

16. The system of claim 1, wherein a respective borehole has a depth from 500-2500 feet within a first threshold.

17. A method for constructing geothermal fields, comprising:

drilling, via a coiled tubing, a borehole of a geothermal field;

inserting, via the coiled tubing, a geothermal loop into the borehole; and grouting, via the coiled tubing, the geothermal loop.

18. The method of claim 17, further comprising:

prior to drilling the borehole:

drilling a rathole via a rotary drilling rig that is different from the coiled tubing; and installing a casing at the rathole.

19. The method of claim 18, further comprising:

sealing the casing via an inflatable packer.

20. The method of claim 17, further comprising:

collecting drill cuttings during the drilling; and injecting the drill cuttings into sub-surfaces around the borehole during the grouting.

* * * * *